US009556396B2

(12) United States Patent
Germaine et al.

(10) Patent No.: US 9,556,396 B2
(45) Date of Patent: Jan. 31, 2017

(54) GREASE FORMULATIONS

(75) Inventors: Gilbert Robert Bernard Germaine, Petit Couronne (FR); David John Wedlock, Chester (GB); Alan Richard Wheatley, Chester (GB)

(73) Assignee: SHELL OIL COMPANY, Houston, TX (US)

( * ) Notice: Subject to any disclaimer, the term of this patent is extended or adjusted under 35 U.S.C. 154(b) by 359 days.

(21) Appl. No.: 12/746,890

(22) PCT Filed: Dec. 9, 2008

(86) PCT No.: PCT/EP2008/067116

§ 371 (c)(1),
(2), (4) Date: Jul. 26, 2010

(87) PCT Pub. No.: WO2009/074577

PCT Pub. Date: Jun. 18, 2009

(65) Prior Publication Data

US 2010/0298187 A1 Nov. 25, 2010

(30) Foreign Application Priority Data

Dec. 11, 2007 (EP) ..... 07291492

(51) Int. Cl.
*C10M 169/02* (2006.01)
*C10M 107/02* (2006.01)

(52) U.S. Cl.
CPC ..... *C10M 169/02* (2013.01); *C10M 107/02* (2013.01); *C10M 2205/173* (2013.01); *C10M 2207/1285* (2013.01); *C10M 2207/40* (2013.01); *C10N 2230/00* (2013.01); *C10N 2230/02* (2013.01); *C10N 2230/06* (2013.01); *C10N 2230/08* (2013.01); *C10N 2230/10* (2013.01); *C10N 2230/12* (2013.01); *C10N 2250/10* (2013.01)

(58) Field of Classification Search
CPC ..... C10M 117/02; C10M 117/04; C10M 207/106; C10M 2205/17
USPC ..... 508/539
See application file for complete search history.

(56) References Cited

U.S. PATENT DOCUMENTS

| | | | | |
|---|---|---|---|---|
| 2,197,263 | A | 4/1940 | Carmichael et al. | 87/9 |
| 2,564,561 | A | 8/1951 | Carmichael et al. | 252/40.5 |
| 2,999,066 | A | 9/1961 | Liddy | 252/39 |
| 4,125,566 | A | 11/1978 | Dinh et al. | 260/676 R |
| 4,343,692 | A | 8/1982 | Winquist | 208/111 |
| 4,478,955 | A | 10/1984 | Pesa et al. | 518/713 |
| 4,574,043 | A | 3/1986 | Chester et al. | 208/59 |
| 4,795,546 | A | 1/1989 | Miller | 208/97 |
| 4,859,311 | A | 8/1989 | Miller | 208/89 |
| 4,943,672 | A | 7/1990 | Hamner, deceased et al. | 585/737 |
| 5,053,373 | A | 10/1991 | Zones | 502/64 |
| 5,059,299 | A * | 10/1991 | Cody et al. | 208/27 |
| 5,157,191 | A | 10/1992 | Bowes et al. | 585/533 |
| 5,252,527 | A | 10/1993 | Zones | 502/64 |
| 5,558,807 | A | 9/1996 | Kim | 508/251 |
| 5,560,848 | A * | 10/1996 | Kim | 508/254 |
| 5,612,297 | A | 3/1997 | Kamakura et al. | 508/363 |
| 5,650,380 | A | 7/1997 | Fletcher | 508/168 |
| 5,851,969 | A * | 12/1998 | Andrew et al. | 508/556 |
| 6,332,974 | B1 * | 12/2001 | Wittenbrink et al. | 208/18 |
| 6,642,187 | B1 | 11/2003 | Schwind et al. | 508/186 |
| 6,916,768 | B2 | 7/2005 | Ward et al. | 508/522 |
| 7,053,254 | B2 | 5/2006 | Miller | 585/1 |
| 2004/0065581 | A1 | 4/2004 | Jiang et al. | 208/18 |
| 2004/0167045 | A1 * | 8/2004 | Ward et al. | 508/552 |
| 2004/0178118 | A1 * | 9/2004 | Rosenbaum et al. | 208/18 |
| 2006/0196807 | A1 * | 9/2006 | Rosenbaum et al. | 208/19 |
| 2008/0020958 | A1 | 1/2008 | Poirier et al. | |

FOREIGN PATENT DOCUMENTS

| | | | |
|---|---|---|---|
| AU | 698391 | 1/1997 | C07C 1/00 |
| CN | 1608121 | 4/2005 | |
| EP | 147873 | 7/1985 | C07C 1/04 |
| EP | 532118 | 3/1993 | C10G 47/14 |
| EP | 582347 | 2/1994 | |
| EP | 583836 | 2/1994 | C10G 65/12 |
| EP | 666894 | 8/1995 | C10G 45/60 |
| EP | 668342 | 8/1995 | C10G 65/04 |
| EP | 712922 | 5/1996 | C10G 25/00 |
| EP | 776959 | 6/1997 | C10G 65/04 |
| EP | 1366134 | 12/2003 | C10G 2/00 |
| EP | 1382639 | 1/2004 | C08L 25/06 |

(Continued)

OTHER PUBLICATIONS

The Shell Middle Distillate Synthesis Process, by Maarten van der Burgt et al., 5th Synfuels Worldwide Symposium, Washington DC, Nov. 1985.

Nov. 1989 publication of the same title from Shell International Petroleum Co., Ltd., London, UK.

Ryland, Lloyd B., et al., "Cracking Catalysts," Catalysis: vol. VII, Ed. Paul Emmett, NY 1960, pp. 5-9.

International Search Report for TS7682 PCT dated Jun. 24, 2010 for Application No. PCT/EP2008/067116 filed Dec. 9, 2008.

CCPIT Patent & Trademark Law Office, Action Report dated Sep. 20, 2012, Chinese Appliction No. 200880124831.2.

(Continued)

*Primary Examiner* — Prem C Singh
*Assistant Examiner* — Francis C Campanell

(57) ABSTRACT

A grease formulation containing a thickener and a Fischer-Tropsch derived base oil, in particular a heavy or extra heavy base oil. The use of a Fischer-Tropsch oil results in an increase in thickener concentration and in improved properties such as anti-wear and copper corrosion performance. Also provided is the use of a Fischer-Tropsch derived base oil in a grease formulation, for the purpose of improving its anti-wear and/or copper corrosion performance, and/or for reducing the concentration of an additive in the formulation.

18 Claims, No Drawings

(56) References Cited

FOREIGN PATENT DOCUMENTS

| | | | |
|---|---|---|---|
| EP | 1534801 | 6/2005 | C10G 21/00 |
| EP | 1516038 | 2/2006 | C10G 67/06 |
| EP | 1719812 | 11/2006 | C10M 125/04 |
| EP | 1837391 | 2/2011 | C10M 171/00 |
| GB | 2077289 | 12/1981 | C07C 1/04 |
| GB | 2408749 | 6/2005 | C10M 115/08 |
| JP | 2005506396 | 3/2005 | |
| JP | 2006518415 | 8/2008 | |
| WO | WO9201657 | 2/1992 | C07C 5/13 |
| WO | WO9220759 | 11/1992 | C10G 47/10 |
| WO | WO9410264 | 5/1994 | C10G 70/02 |
| WO | WO9718278 | 5/1997 | C10G 47/00 |
| WO | WO9920720 | 4/1999 | C10M 143/08 |
| WO | WO9934917 | 7/1999 | B01J 23/75 |
| WO | WO0104179 | 1/2001 | C08G 65/26 |
| WO | 02070627 | 9/2002 | |
| WO | WO02070627 | 9/2002 | C10G 65/00 |
| WO | WO02070629 | 9/2002 | C10G 65/12 |
| WO | WO2004003113 | 1/2004 | C10G 65/04 |
| WO | WO2004033607 | 4/2004 | C10M 105/04 |
| WO | 2004074413 | 9/2004 | |
| WO | WO2005063941 | 7/2005 | C10G 67/04 |
| WO | WO2006094264 | 9/2006 | |
| WO | WO2008013697 | 1/2008 | C10M 169/00 |

OTHER PUBLICATIONS

Japan Patent Office, Third Patent Examination Dept., Notification dated Sep. 11, 2013, Japanese Patent Application No. 2010-537420.

* cited by examiner

GREASE FORMULATIONS

The present application claims priority from European Patent Application 07291492.2 filed 11 Dec. 2007.

FIELD OF THE INVENTION

This invention relates to grease formulations and their preparation, and to the use of certain types of base oil in grease formulations.

BACKGROUND TO THE INVENTION

It is known to prepare industrial and automotive grease formulations by mixing a thickener, for example a soap, into a suitable base oil. The oils used for this purpose tend to be mineral-derived base oils, typically of the same type as would normally be used in oil-based lubricants.

Depending on its intended use, the properties of a grease formulation need to be carefully tailored to meet applicable specifications and/or consumer demands. It needs to have a suitable consistency, for example. Ideally it should exhibit good mechanical stability and oil separation. Good oxidation stability and cold flow properties are also desirable, as is good anti-wear performance.

Often it can be difficult to achieve all of the desired properties in a typical mineral oil-based grease formulation. In such cases, one or more additives need to be included in the formulation so as to modify its performance. The inclusion of additives does, however, significantly increase the cost of producing the formulation. It would therefore be desirable to provide a grease formulation having certain desired properties, but with lower additive levels than are currently needed to achieve those properties.

Aside from the mineral-derived base oils, it is also now known to prepare base oils via a Fischer-Tropsch condensation process. This process is a reaction which converts carbon monoxide and hydrogen into longer chain, usually paraffinic, hydrocarbons in the presence of an appropriate catalyst and typically at elevated temperatures (e.g. 125 to 300° C., preferably 175 to 250° C.) and/or pressures (e.g. 5 to 100 bar, preferably 12 to 50 bar). Hydrogen:carbon monoxide ratios other than 2:1 may be employed if desired.

The Fischer-Tropsch process can be used to prepare a range of hydrocarbon fuels, including LPG, naphtha, kerosene and gas oil fractions. The heavier fractions can yield, following hydroprocessing and vacuum distillation, a series of base oils having different distillation properties and viscosities, which are useful as lubricating base oil stocks.

The higher molecular weight, so-called "bottoms" product that remains after recovering the lubricating base oil cuts from the vacuum column is usually recycled to a hydrocracking unit for conversion into lower molecular weight products, typically being considered unsuitable for use as a lubricating base oil itself. This product is often known as an "extra heavy" base oil cut.

Fischer-Tropsch derived base oils tend to have excellent low temperature properties, for example low pour points, and relatively good oxidation stability. They are also attractive because of the relatively simple process used to make them as compared to similar oils prepared from mineral crude sources. However they also have, as a result of the catalytic processes used to prepare them, relatively low polarity. This in turn gives them a relatively low affinity (solvency) for the high polarity thickeners (for example soaps) contained in grease formulations, and means that their inclusion in grease formulations would necessitate the use of relatively high thickener concentrations in order to achieve an appropriate consistency or stiffness (penetration). High thickener concentrations tend to be seen as undesirable due to the associated increased raw material costs. It is also generally believed that too high a thickener content in a grease formulation can lead to problems when pumping the formulation, particularly at lower temperatures; it is therefore thought to be desirable to seek to reduce rather than increase thickener concentrations.

It has now surprisingly been found that when a Fischer-Tropsch derived base oil is used in a grease formulation, with correspondingly increased levels of thickener, improvements in the properties and performance of the overall formulation can result, in particular in anti-wear performance. These improvements can in many cases outweigh the potential disadvantages of the higher thickener content.

Other relatively low polarity base oils have been used in grease formulations in the past, although not without their disadvantages. For example, synthetic polyalpha-olefins (PAOs) are occasionally used as a base for greases, but their high cost makes them suitable only for special applications. So-called "XHVI" (extra high viscosity index) oils, which are highly refined and chemically treated mineral oils, are also sometimes used in grease formulations, but these oils are only available with low viscosities which again limits their potential applications.

It would therefore be desirable to provide a grease formulation which could overcome or at least mitigate the above described problems, and ideally benefit from one or more improvements in overall performance.

STATEMENTS OF THE INVENTION

According to a first aspect of the present invention, there is provided a grease formulation containing a thickener and a Fischer-Tropsch derived base oil, wherein the Fischer-Tropsch derived base oil has a kinematic viscosity at 100° C. of from 8 to 30 $mm^2/s$.

The use of a Fischer-Tropsch derived base oil in a grease formulation necessitates, as predicted, a higher quantity of thickener than would be needed, to achieve a given consistency, if a mineral base oil were used instead. This is due to the relatively low polarity of the Fischer-Tropsch derived oil, as described above. Nevertheless the inclusion of a Fischer-Tropsch derived base oil, and the consequently higher thickener concentration, has also been found to impart significant advantages to the formulation. In particular, it has been found to improve the anti-wear properties of the formulation, and in cases to improve its copper corrosion performance, as well as to enhance consistency and to improve oxidation stability, cold flow performance, mechanical stability and oil separation. It appears that the increased thickener concentration and the Fischer-Tropsch derived base oil can together contribute to significantly improved properties in the overall grease formulation, which improvements can compensate, at least partially, for the increased costs associated with higher thickener concentrations.

These improvements can in turn make possible the use of lower levels of performance enhancing additives such as anti-wear additives, copper corrosion inhibitors, viscosity modifiers, antioxidants, extreme pressure additives, friction modifiers, rust inhibitors and cold flow additives, thus reducing production costs. In cases a grease formulation according to the invention may be entirely free of such additives. Moreover the use of a Fischer-Tropsch derived base oil can itself serve to reduce production costs, since such base oils tend to be cheaper to produce than their mineral-derived counterparts.

Fischer-Tropsch derived oils are also known to be more readily biodegradable than mineral ones, and to have high purity. They can provide a "cleaner" alternative to mineral derived base oils, and as a result may be more suitable for inclusion in grease formulations which are intended to be used in environmentally sensitive areas, or for example in machinery handling sensitive consumer products such as foods, cosmetics or pharmaceuticals. This is likely to be particularly true of grease formulations containing no, or only low levels of, additives, as may be possible in accordance with the present invention.

In general terms, the Fischer-Tropsch derived base oil used in a grease formulation according to the invention may have a kinematic viscosity at 100° C. (VK 100), as measured by ASTM D-445, of from 5 to 30 or from 5 to 25 or from 5 to 20 $mm^2/s$.

The Fischer-Tropsch derived base oil is suitably a heavy base oil, which term includes the oils known as "extra heavy" base oils. It may for example have a VK 100 of from 8 or 9 or 10 to 30 $mm^2/s$ in the case of an extra heavy base oil.

Base oils having such high viscosities, coupled with the other advantageous properties described above, are achievable using the Fischer-Tropsch process but not, generally, from mineral crude sources. They are however much cheaper to produce, and more readily available, than the synthetic high viscosity alternative, polyalpha-olefins.

Fischer-Tropsch derived heavy base oils tend to exhibit better low temperature behaviour than mineral base oils of lower viscosity. They also tend to have excellent viscosity indices (which provide a measure of the temperature dependence of their viscosity) compared to their mineral-derived counterparts and even compared to poly alpha olefins, which are high viscosity synthetic polymers used in some cases as substitutes for heavy and extra heavy base oils. They can therefore be used, in accordance with the invention, to enhance the viscosity of grease formulations, without the need to blend in so-called "brightstock" (high viscosity mineral base oil) fractions or other viscosity modifiers.

There are currently no mineral-derived base oils having viscosities comparable to the Fischer-Tropsch derived extra heavy base oils. The use of such Fischer-Tropsch derived base oils in grease formulations, in accordance with the present invention, can therefore enable the achievement of unique grease properties, in particular the advantageous properties described above and demonstrated in the examples below.

The Fischer-Tropsch derived base oil suitably has an initial boiling point (ASTM D-2887) of from 360 to 460° C., for example from 370 to 450° C. or from 380 to 445° C. It suitably has a final boiling point (ASTM D-2887) of from 550 to 770° C., for example from 560 to 760° C. or from 570 to 750° C.

It suitably has a density (IP 365/97) of from 0.80 to 0.86 g/ml, for example from 0.81 to 0.85 g/ml or from 0.82 to 0.84 mg/ml.

In the present context, the term "Fischer-Tropsch derived" means that a material is, or derives from, a synthesis product of a Fischer-Tropsch condensation process, typically a Fischer-Tropsch derived wax. The term "non-Fischer-Tropsch derived" may be interpreted accordingly. A Fischer-Tropsch derived oil will therefore be a hydrocarbon stream of which a substantial portion, except for added hydrogen, is derived directly or indirectly from a Fischer-Tropsch condensation process.

A Fischer-Tropsch derived product may also be referred to as a GTL product.

Hydrocarbon products may be obtained directly from the Fischer-Tropsch reaction, or indirectly for instance by fractionation of Fischer-Tropsch synthesis products or from hydrotreated Fischer-Tropsch synthesis products. Hydrotreatment can involve hydrocracking to adjust the boiling range (see, e.g., GB-B-2077289 and EP-A-0147873) and/or hydroisomerisation which can improve cold flow properties by increasing the proportion of branched paraffins. EP-A-0583836 describes a two step hydrotreatment process in which a Fischer-Tropsch synthesis product is firstly subjected to hydroconversion under conditions such that it undergoes substantially no isomerisation or hydrocracking (this hydrogenates the olefinic and oxygen-containing components), and then at least part of the resultant product is hydroconverted under conditions such that hydrocracking and isomerisation occur to yield a substantially paraffinic hydrocarbon fuel. The desired fraction(s) may subsequently be isolated for instance by distillation.

Other post-synthesis treatments, such as polymerisation, alkylation, distillation, cracking-decarboxylation, isomerisation and hydroreforming, may be employed to modify the properties of Fischer-Tropsch condensation products, as described for instance in U.S. Pat. No. 4,125,566 and U.S. Pat. No. 4,478,955.

Typical catalysts for the Fischer-Tropsch synthesis of paraffinic hydrocarbons comprise, as the catalytically active component, a metal from Group VIII of the periodic table, in particular ruthenium, iron, cobalt or nickel. Suitable such catalysts are described for instance in EP-A-0 583 836 (pages 3 and 4).

An example of a Fischer-Tropsch process is the SMDS (Shell Middle Distillate Synthesis) described in "The Shell Middle Distillate Synthesis Process", van der Burgt et al, paper delivered at the 5th Synfuels Worldwide Symposium, Washington D.C., November 1985; see also the November 1989 publication of the same title from Shell International Petroleum Company Ltd, London, UK. This process (also sometimes referred to as the Shell "Gas-To-Liquids" or "GTL" technology) produces middle distillate range products by conversion of a natural gas (primarily methane) derived synthesis gas into a heavy long chain hydrocarbon (paraffin) wax which can then be hydroconverted and fractionated to produce liquid transport fuels such as the gas oils usable in automotive diesel fuels. Base oils, having a range of viscosities and including both light and intermediate fractions as well as the heavier oils, may also be produced by such a process.

By virtue of the Fischer-Tropsch process, a Fischer-Tropsch derived oil has essentially no, or undetectable levels of, sulphur and nitrogen. Compounds containing these heteroatoms tend to act as poisons for Fischer-Tropsch catalysts and are therefore removed from the synthesis gas feed. This can, in certain respects, bring additional benefits to grease formulations in accordance with the present invention.

Further, the Fischer-Tropsch process as usually operated produces no or virtually no aromatic components. The aromatics content of a Fischer-Tropsch derived product, suitably determined by ASTM D4629, will typically be below 1 wt %, preferably below 0.5 wt % and more preferably below 0.1 wt %.

Generally speaking, as described above, Fischer-Tropsch derived hydrocarbon products have relatively low levels of polar components, in particular polar surfactants, for instance compared to mineral derived oils. Such polar components may include for example oxygenates, and sulphur and nitrogen containing compounds. A low level of sulphur in a Fischer-Tropsch derived oil is generally indicative of low levels of both oxygenates and nitrogen containing compounds, since all are removed by the same treatment processes.

The Fischer-Tropsch derived base oil used in the present invention is suitably obtained by hydrocracking a paraffinic, conveniently Fischer-Tropsch derived, wax and preferably dewaxing the resultant waxy raffinate for instance by solvent or more preferably catalytic dewaxing. The paraffinic wax may be a slack wax. The raffinate can be distilled to produce a number of different products, including a light base oil stream having a VK 100 of around 2 to 4 $mm^2/s$, a heavy base oil stream having a VK 100 of about 4 to 8 $mm^2/s$, typically around 8 $mm^2/s$, and an "extra heavy" base oil stream having a VK 100 of around 8 to 30 or 8 to 25 $mm^2/s$, typically about 20 $mm^2/s$. The base oil used in the present invention may in particular be derived from the latter two streams.

A Fischer-Tropsch derived heavy base oil is suitably a base oil which has been derived, whether directly or indirectly following one or more downstream processing steps, from a Fischer-Tropsch "bottoms" (i.e. high boiling) product. A Fischer-Tropsch bottoms product is a hydrocarbon product recovered from the bottom of a fractionation column, usually a vacuum column, following fractionation of a Fischer-Tropsch derived feed stream. WO-A-02070629, for example, describes a process for preparing iso-paraffinic base oils from a wax made by a Fischer-Tropsch process: the products of such a process may be used in grease formulations according to the present invention.

Since the base oil used in the present invention is derived from a Fischer-Tropsch product (typically a wax), it will be largely paraffinic in nature, and will typically contain a major proportion of iso-paraffins. Suitably, the base oil is a paraffinic base oil having a paraffin content of greater than 80 wt %. It suitably has a saturates content (as measured by IP-386) of greater than 98 wt %, and an n-paraffin content of 0.1 wt % or less, in cases zero (i.e. its i:n ratio will typically be extremely high).

Preferably it contains hydrocarbon molecules having consecutive numbers of carbon atoms, such that it comprises a series of iso-paraffins having n, n+1, n+2, n+3 and n+4 carbon atoms, where n is from 20 to 35. This series is a consequence of the Fischer-Tropsch hydrocarbon synthesis reaction from which the base oil derives, following isomerisation of the wax feed.

Preferably the saturates content of the base oil is greater than 99 wt %, more preferably greater than 99.5 wt %.

The base oil preferably has a content of naphthenic compounds of from 0 to 20 wt %, more preferably of from 1 to 20 wt %.

The content of naphthenic compounds in a base oil, and the presence of the desired continuous series of iso-paraffins, may be measured by the Field Desorption/Field Ionisation (FD/FI) technique. According to this technique, an oil sample is firstly separated into a polar (aromatic) phase and a non-polar (saturates) phase by the high performance liquid chromatography (HPLC) method IP 368/01 but using pentane instead of hexane as the mobile phase. The aromatic and saturates fractions are then analysed using for instance a Finnigan MAT90 mass spectrometer equipped with a FD/FI interface, the FI (a "soft" ionisation technique) being used to determine hydrocarbon types in terms of carbon number and hydrogen deficiency.

The type classification of compounds in mass spectrometry is determined by the characteristic ions formed and is normally classified by "Z number". This is given by the general formula for all hydrocarbon species: $C_nH_{2n+z}$. Because the saturates phase is analysed separately from the aromatic phase it is possible to determine the content of the different iso-paraffins having the same stoichiometry or n-number. The results from the mass spectrometer can be processed using commercially available software (for example Poly 32, available from Sierra Analytics LLC, 3453 Dragoo Park Drive, Modesto, Calif. GA95350 USA) to determine the relative proportions of each hydrocarbon type.

The pour point of the base oil used in a grease formulation according to the invention, as measured by ASTM D-4950, may be −5° C. or below, or −10 or −15° C. or below. It may for example be from −60 to −10° C., preferably from −50 to −20° C.

A Fischer-Tropsch derived heavy base oil for use in a grease formulation according to the invention is a heavy hydrocarbon product comprising at least 95 wt % paraffin molecules. Preferably, such a heavy base oil is prepared from a Fischer-Tropsch wax and comprises more than 98 wt % of saturated, paraffinic hydrocarbons. Preferably at least 85 wt %, more preferably at least 90 wt %, yet more preferably at least 95 wt %, and most preferably at least 98 wt % of these paraffinic hydrocarbon molecules are iso-paraffinic. Preferably, at least 85 wt % of the saturated, paraffinic hydrocarbons are non-cyclic hydrocarbons. Naphthenic compounds (paraffinic cyclic hydrocarbons) are preferably present in an amount of no more than 15 wt %, more preferably less than 10 wt %.

The heavy base oil is typically a liquid both at 100° C. and under ambient conditions, i.e. at 25° C. and one atmosphere (101 kPa) pressure.

It will suitably have a viscosity index (ASTM D-2270) of 120 or greater, more suitably from 130 to 170.

The VK 100 of a Fischer-Tropsch derived extra heavy base oil should be at least 8 $mm^2/s$. Preferably, its VK 100 is at least 10 $mm^2/s$, more preferably at least 13 mm2/s, yet more preferably at least 15 $mm^2/s$, again more preferably at least 17 $mm^2/s$, and still more preferably at least 20 $mm^2/s$. Kinematic viscosities referred to in this specification may be determined according to ASTM D-445, whilst viscosity indices (VI) may be determined using ASTM D-2270.

A Fischer-Tropsch derived heavy base oil preferably has an initial boiling point (IBP) of at least 380° C. More preferably, its IBP is at least 400° C., yet more preferably at least 440° C. The boiling range distribution of samples having a boiling range above 535° C. may be measured according to ASTM D-6352, whilst for lower boiling materials, boiling range distributions may be measured according to ASTM D-2887.

The initial and end boiling point values referred to herein are nominal and refer to the T5 and T95 cut-points (boiling temperatures) obtained by gas chromatograph simulated distillation (GCD).

Since conventional petroleum derived hydrocarbons and Fischer-Tropsch derived hydrocarbons comprise a mixture of varying molecular weight components having a wide boiling range, this disclosure will where necessary refer to the 10 wt % recovery point and the 90 wt % recovery point of the respective boiling ranges. The 10 wt % recovery point refers to that temperature at which 10 wt % of the hydrocarbons present within that cut will vaporise at atmospheric pressure, and could thus be recovered. Similarly, the 90 wt % recovery point refers to the temperature at which 90 wt % of the hydrocarbons present will vaporise at atmospheric pressure. When referring to a boiling range distribution, the boiling range between the 10 wt % and 90 wt % recovery boiling points is referred to in this specification.

Molecular weights referred to in this specification may be determined according to ASTM D-2503. A Fischer-Tropsch derived heavy base oil suitably contains at least 95 wt % of $C_{25+}$ hydrocarbon molecules. More preferably, it contains at least 75 wt % of $C_{35+}$ hydrocarbon molecules.

A Fischer-Tropsch derived heavy base oil typically has a cloud point between +49° C. and −60° C. Preferably, it has a cloud point between +30° C. and −55° C., more preferably between +10° C. and −50° C. "Cloud point" refers to the temperature at which a base oil begins to develop a haze, and may be determined according to ASTM D-5773.

It has been found that at a given feed composition and boiling range (as defined by the lower cut point from the distillate base oil and gas oil fractions after dewaxing) for the bottoms product, the pour point and the kinematic viscosity of a Fischer-Tropsch derived heavy base oil are linked to the severity of the dewaxing treatment. A Fischer-Tropsch derived heavy base oil for use in a grease formulation according to the invention may have a pour point of below −8 or −9° C., or preferably even lower such as −30° C. or below, and has thus typically been subjected to relatively severe (i.e. high temperature catalytic) dewaxing as opposed to the relatively mild dewaxing which results in a pour point of from 0 to −9° C., for instance around −6° C. "Pour point" refers to the temperature at which a base oil sample will begin to flow under carefully controlled conditions. The pour points referred to herein may be determined according to ASTM D-97-93 or D-5950.

Thus in cases a Fischer-Tropsch derived heavy base oil may have a pour point of −15° C. or lower, preferably of −20 or −25 or −28 or even −30° C. or lower.

A Fischer-Tropsch derived heavy base oil preferably has a viscosity index of from 120 to 160. It will preferably contain no or very few sulphur and nitrogen containing compounds. As described above, this is typical for a product derived from a Fischer-Tropsch reaction, which uses synthesis gas containing almost no impurities. Preferably, the base oil contains sulphur, nitrogen and metals (in the form of hydrocarbon compounds containing them) in amounts of less than 50 ppmw (parts per million by weight), more preferably less than 20 ppmw, yet more preferably less than 10 ppmw. Most preferably it will comprise sulphur and nitrogen at levels generally below the detection limits, which are currently 5 ppmw for sulphur and 1 ppmw for nitrogen when using for instance X-ray or Antek Nitrogen tests for determination. However, sulphur may be introduced through the use of sulphided hydrocracking/hydrodewaxing and/or sulphided catalytic dewaxing catalysts.

A Fischer-Tropsch derived heavy base oil used in the present invention is preferably separated as a residual fraction from the hydrocarbons produced during a Fischer-Tropsch synthesis reaction and subsequent hydrocracking and dewaxing steps.

More preferably this fraction is a distillation residue comprising the highest molecular weight compounds still present in the product of the hydroisomerisation step. The 10 wt % recovery boiling point of said fraction is preferably above 370° C., more preferably above 400° C. and most preferably above 500° C. for certain embodiments of the present invention.

A Fischer-Tropsch derived extra heavy base oil (of VK 100 typically 8 or 9 $mm^2/s$ or higher) can be further characterised by its content of different carbon species. More particularly, it can be characterised by the percentage of epsilon methylene carbon atoms which it contains, i.e. the percentage of recurring methylene carbons which are four or more carbons removed from an end group and/or a branch (further referred to as CH2>4), as compared to its percentage of isopropyl carbon atoms. In the following text, the ratio of the percentage of epsilon methylene carbon atoms to the percentage of isopropyl carbon atoms (i.e. carbon atoms in isopropyl branches), as measured for the base oil as a whole, is referred to as the epsilon:isopropyl ratio.

A Fischer-Tropsch derived heavy base oil for use in the present invention preferably has an average degree of branching in the molecules of above 10 alkyl branches per 100 carbon atoms, as determined in line with the method disclosed in U.S. Pat. No. 7,053,254.

The branching properties as well as the carbon composition of a Fischer-Tropsch derived base oil can conveniently be determined by analysing a sample of the oil using 13C-NMR, vapour pressure osmometry (VPO) and field ionisation mass spectrometry (FIMS), as follows. The average molecular mass is obtained via vapour pressure osmometry (VPO). Then samples are characterised at the molecular level by means of nuclear magnetic resonance (NMR) spectroscopy. The Z number and the average carbon number are determined by FIMS.

Conventional NMR spectra can have the problem of signal overlap due to the presence of a great number of isomers in a base oil composition. To overcome this problem, selected multiplet subspectral carbon-13 nuclear magnetic resonance ($^{13}C$-NMR) analyses can be applied. In particular, gated spin echo (GASPE) can be applied to obtain quantitative $CH_n$ subspectra. The quantitative data obtained from GASPE can have a better accuracy than those from distortionless enhancement by polarisation transfer (DEPT, as for instance applied in the process disclosed in U.S. Pat. No. 7,053,254).

On the basis of the GASPE data and of the average molecular mass obtained via VPO, the average number of branches and aliphatic rings can be calculated. Further, on the basis of GASPE, the distribution of side chain lengths and the positions of the methyl groups along the straight chains can be obtained.

Quantitative carbon multiplicity analysis is normally carried out entirely at room temperature. However this is only applicable to materials which are liquid under these conditions. This method is applicable is applicable to any Fischer-Tropsch derived or base oil material which is hazy or a waxy solid at room temperature and which cannot therefore be analysed by the normal method. A suitable methodology for the NMR measurements is as follows: deuterated chloroform ($CDC_{13}$) is employed as the solvent for determination of quantitative carbon multiplicity analysis, limiting the maximum measurement temperature to 50° C. for practical reasons. A base oil sample is heated in an oven at 50° C. until it forms a clear and liquid homogeneous product. A portion of the sample is then transferred into an NMR tube. Preferably, the NMR tube and any apparatus used in the transfer of the sample are kept at this temperature. The above-identified solvent is then added and the tube shaken to dissolve the sample, optionally involving reheating of the sample. To prevent solidification of any high melting material in the sample, the NMR instrument is maintained at 50° C. during acquisition of the data. The sample is placed in the NMR instrument for a minimum of 5 minutes, to allow the temperature to equilibrate. After this the instrument must be re-shimmed and re-tuned as both these adjustments will change considerably at the elevated temperature, and the NMR data can now be acquired.

A $CH_3$ subspectrum is obtained using the GASPE pulse sequence, by addition of a CSE spectrum (standard spin echo) to a 1/J GASPE (gated acquisition spin echo). The resultant spectrum contains primary ($CH_3$) and tertiary (CH) carbon peaks only.

Then the various carbon branch carbon resonances are assigned to specific positions and lengths applying tabulated data, and correcting for chain ends. The subspectrum is then integrated to give quantitative values for the different CH3 signals, as follows.

1. $CH_3$-carbon a. 25 ppm chemical shift (referenced against TMS).

b. 19 and 21 ppm can be identified as methyl branches of the following general type (see formula 1):

Formula 1

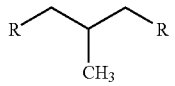

c. Distinct intense signals in the region of 22 to 24 ppm can be unambiguously identified as isopropyl end groups of the following general structure (see Formula 2):

Formula 2

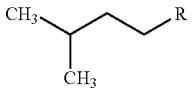

In this instance, one of the methyl carbon atoms is classified as a termination of the main chain, the other as a branch. Therefore when calculating methyl branch content, the intensity of these signals is halved.

d. Further, several weak signals in the region of 15 to 19 ppm are considered to belong to an isopropyl group with an additional branch in the 3 position.

e. Observed in the spectrum are some weak signals in the region 8 to 8.5 ppm, most likely pertaining to 3,3-dimethyl substituted structures (Formula 3):

Formula 3

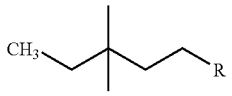

In this case the observed signal is for the terminal CH3, but there are two corresponding methyl branches. Therefore the integral value of these signals is doubled (the signals for the two methyl branches are not counted independently).

The overall estimation of methyl branch content is thus based on the following calculation ("Int" representing the term "Integral", Formula 4):

$$\Sigma(\text{integrals methyls})=\text{Int 19 to 20 ppm}+(\text{Int 22 to 25 ppm})/2+\text{Int 15 to 19 ppm}+(\text{Int 7.0 to 9 ppm})*2 \quad \text{(Formula 4).}$$

2. The calculation of ethyl branch content is based on two distinct relatively intense signals observed at 11.5 and 10.9 ppm, assuming the isopentyl end group content to be negligible, based on the evidence from other peak assignments. Hence, the calculation of ethyl branch content is based solely on the integral of the signals at 10 to 11.2 ppm.

3. The overall theoretical terminal CH3 content is calculated based on the "Z" content and the average carbon number, as determined by FIMS. The C3+ branch content is then determined by subtracting from the theoretical terminal CH3 content the known terminal CH3 contents i.e. half of the isopropyl value, the 3-methyl substituted value and the value for 3,3-dimethyl substituted structures, thereby resulting in a value for the signals in the 14 ppm region which belong to CH3s terminating the chain, the difference being the value for the C3+ branches:

$$\Sigma(\text{integrals C3+branches})=\text{Int 14-15 ppm}-((\text{theoretical terminal CH3})-(\text{Int 11.2 to 11.8 ppm})-(\text{Int 22 to 25 ppm})/2-\text{Int 7 to 9 ppm})) \quad \text{(Formula 5).}$$

In its broadest sense, the present invention embraces a grease formulation containing a paraffinic base oil, in particular a heavy base oil, having one or more of the above described properties, whether or not the oil is actually Fischer-Tropsch derived.

A grease formulation according to the invention may contain more than one Fischer-Tropsch derived base oil, for example a blend of two or more such base oils which has, overall, the desired properties, in particular viscosity.

The Fischer-Tropsch derived base oil may be the only base oil component in the formulation. Alternatively, it may be used in combination with one or more additional base oil components. The formulation may for example additionally contain a non-Fischer-Tropsch derived base oil or mixture thereof. Thus, in accordance with the invention, a Fischer-Tropsch derived base oil may be used partially to replace a non-Fischer-Tropsch derived base oil in a grease formulation, for example for the purpose of achieving one or more of the above described advantages. This can allow greater flexibility in the formulation of greases, with wider options for balancing production costs against performance.

The preferred properties of such additional base oil components may be as described above for the Fischer-Tropsch derived base oil. The overall formulation will suitably contain less than 40 or 30 or 20 wt %, preferably less than 10 or 5 wt %, of such additional base oil components.

Examples of additional base oil components include mineral based paraffinic and naphthenic type base oils and synthetic base oils, for example esters, polyalpha-olefins, polyalkylene glycols and the like. Of these, esters can be beneficial in order to improve the biodegradability of a grease formulation. The content of an additional ester base oil, if present, may be from 1 to 30 wt % based on the overall formulation, more preferably from 5 to 25 wt %. Suitable ester compounds are those derivable by reacting an aliphatic mono-, di- and/or polycarboxylic acid with isotridecyl alcohol under esterification conditions. Examples of such compounds are the isotridecyl esters of octane-1,8-dioic acid, 2-ethylhexane-1,6 dioic acid and dodecane-1,12-dioic acid. Preferably the ester compound is a so-called pentaerythritol tetrafattyacid ester (PET ester), as made by esterification of pentaerythritol (PET) with branched or linear fatty acids, preferably $C_6$-$C_{10}$ acids. Such an ester may contain di-PET as an impurity.

It has however been found especially advantageous to use a Fischer-Tropsch derived base oil, in particular a Fischer-Tropsch derived heavy base oil, as substantially the sole base oil component in a grease formulation according to the invention. By "substantially" in this context is meant that more than 70 wt %, preferably more than 90 wt % and most preferably 100 wt % of any base oil components in the formulation are Fischer-Tropsch derived base oils as described above, or at least paraffinic base oils having the preferred properties described above.

A Fischer-Tropsch derived base oil for use in the present invention may be produced by any suitable Fischer-Tropsch process. Examples of Fischer-Tropsch processes are the so-called commercial Slurry Phase Distillate technology of Sasol, the Shell Middle Distillate Synthesis process referred to above and the "AGC-21" Exxon Mobil process. These and other processes are described in more detail in for example EP-A-776959, EP-A-668342, U.S. Pat. No. 4,943,672, U.S. Pat. No. 5,059,299, WO-A-9934917 and WO-A-9920720. Typically the products of these Fischer-Tropsch syntheses will comprise hydrocarbons having from 1 to 100 or even more than 100 carbon atoms.

Where a base oil is one of the desired iso-paraffinic products of a Fischer-Tropsch process, it may be advantageous to use a relatively heavy Fischer-Tropsch derived feed. Such a feed suitably contains at least 30 wt %, preferably at least 50 wt % and more preferably at least 55 wt % of compounds having at least 30 carbon atoms. Furthermore the weight ratio in the feed of compounds having at least 60 carbon atoms to those having at least 30 carbon atoms is preferably at least 0.2, more preferably at least 0.4 and most preferably at least 0.55. If the feed has a 10 wt % recovery boiling point of above 500° C. the wax content will suitably be greater than 50 wt %.

Preferably the Fischer-Tropsch derived feed comprises a $C_{20+}$ fraction having an ASF-alpha value (Anderson-Schulz-Flory chain growth factor) of at least 0.925, preferably at least 0.935, more preferably at least 0.945, even more preferably at least 0.955. Such a Fischer-Tropsch derived feed can be obtained by any process which yields a suitably heavy product as described above.

In general terms, the production of a Fischer-Tropsch derived base oil will involve a Fischer-Tropsch synthesis, a hydroisomerisation step and an optional pour point reducing step. The Fischer-Tropsch synthesis can be performed on synthesis gas prepared from any sort of hydrocarbonaceous material such as coal, natural gas or biological matter such as wood or hay. The hydroisomerisation converts n- to iso-paraffins, thus increasing the degree of branching in the hydrocarbon molecules and improving cold flow properties. Depending on the catalysts and isomerisation conditions used, this step can result in long chain hydrocarbon molecules having relatively highly branched end regions; such molecules tend to exhibit particularly good cold flow performance.

The hydroisomerisation and optional pour point reducing steps may be performed by:

(a) hydrocracking/hydroisomerising a Fischer-Tropsch product, such as the feed described above, and
(b) isolating from the product of step (a), amongst other products, a base oil or base oil intermediate fraction.

If the viscosity and/or pour point of the base oil obtained in step (b) are as desired no further processing is necessary and the oil can be used directly in a formulation according the invention. If required, however, the pour point of a base oil intermediate fraction may be further reduced in a step (c) by means of solvent or more preferably catalytic dewaxing.

A desired viscosity of base oil may be obtained by isolating (by means of distillation) a product having a suitable boiling range and corresponding viscosity, from an intermediate base oil fraction or from a dewaxed oil. The distillation may be a vacuum distillation step.

The hydroconversion/hydroisomerisation reaction of step (a) is preferably performed in the presence of hydrogen and a catalyst, which catalyst can be chosen from those known to one skilled in the art, examples of which are described in more detail below. The catalyst may in principle be any catalyst known in the art to be suitable for isomerising paraffinic molecules. In general, suitable hydroconversion/hydroisomerisation catalysts are those comprising a hydrogenation component supported on a refractory oxide carrier, such as amorphous silica-alumina (ASA), alumina, fluorided alumina, molecular sieves (zeolites) or mixtures of two or more of these.

Preferred catalysts for use in the hydroconversion/hydroisomerisation step (a) include those comprising platinum and/or palladium as the hydrogenation component. A very much preferred hydroconversion/hydroisomerisation catalyst comprises platinum and palladium supported on an amorphous silica-alumina (ASA) carrier. The platinum and/or palladium is suitably present in an amount of from 0.1 to 5.0 wt %, more suitably from 0.2 to 2.0 wt %, calculated as the element and based on the total weight of the carrier. If both elements are present, the weight ratio of platinum to palladium may vary within wide limits, but is suitably in the range of from 0.05 to 10, more suitably from 0.1 to 5. Examples of suitable noble metal on ASA catalysts are, for instance, disclosed in WO-A-9410264 and EP-A-0582347. Other suitable noble metal-based catalysts, such as platinum on a fluorided alumina carrier, are disclosed in e.g. U.S. Pat. No. 5,059,299 and WO-A-9220759.

A second type of suitable hydroconversion/hydroisomerisation catalyst includes those comprising at least one Group VIB metal, preferably tungsten and/or molybdenum, and at least one non-noble Group VIII metal, preferably nickel and/or cobalt, as the hydrogenation component. Either or both metals may be present as an oxide, a sulphide or a combination thereof. The Group VIB metal is suitably present in an amount of from 1 to 35 wt %, more suitably from 5 to 30 wt %, calculated as the element and based on the total weight of the carrier. The non-noble Group VIII metal is suitably present in an amount of from 1 to 25 wt %, preferably from 2 to 15 wt %, calculated as the element and based on the total weight of the carrier. A hydroconversion catalyst of this type, which has been found particularly suitable, is one comprising nickel and tungsten supported on fluorided alumina.

The above non-noble metal based catalysts are preferably used in their sulphided form. In order to maintain the sulphided form of the catalyst during use some sulphur needs to be present in the feed, for example at least 10 mg/kg or more preferably from 50 to 150 mg/kg of sulphur.

A preferred catalyst, which can be used in a non-sulphided form, comprises a non-noble Group VIII metal, e.g. iron or nickel, in conjunction with a Group IB metal, e.g. copper, supported on an acidic support. Copper is preferably present to suppress hydrogenolysis of paraffins to methane. The catalyst preferably has a pore volume in the range from 0.35 to 1.10 ml/g as determined by water absorption, a surface area of from 200 to 500 $m^2/g$ as determined by BET nitrogen adsorption, and a bulk density of from 0.4 to 1.0 g/ml. The catalyst support is preferably made of an amorphous silica-alumina wherein the alumina may be present within a range of from 5 to 96 wt %, preferably from 20 to 85 wt %. The silica content of such a support, as SiO2, is preferably from 15 to 80 wt %. The support may also contain small amounts, for example from 20 to 30 wt %, of a binder such as alumina, silica, a Group IVA metal oxide, a clay, magnesia, etc., preferably alumina or silica.

The preparation of amorphous silica-alumina microspheres has been described by Ryland, Lloyd B., Tamele, M. W. and Wilson, J. N., in "Cracking Catalysts", Catalysis: Volume VII, Ed. Paul H. Emmett, Reinhold Publishing Corporation, New York, 1960, pp. 5-9.

The catalyst may be prepared by co-impregnating the metals from solutions onto the support, drying at 100 to 150° C. and calcining in air at 200 to 550° C. The Group VIII metal may be present in an amount of about 15 wt % or less, preferably from 1 to 12 wt %, whilst the Group IB metal is usually present in a lower amount: for example the weight ratio of the Group IB metal to the Group VIII metal may be from about 1:2 to about 1:20.

A typical catalyst is specified below:

| | |
|---|---|
| Ni, wt % | 2.5-3.5 |
| Cu, wt % | 0.25-0.35 |
| $Al_2O_3$—$SiO_2$ wt % | 65-75 |
| $Al_2O_3$ (binder) wt % | 25-30 |
| Surface area | 290-325 $m^2/g$ |
| Pore volume (Hg) | 0.35-0.45 ml/g |
| Bulk density | 0.58-0.68 g/ml. |

Another class of suitable hydroconversion/hydroisomerisation catalysts includes those based on molecular sieve type materials, suitably comprising at least one Group VIII metal component, preferably Pt and/or Pd, as the hydrogenation component. Suitable zeolitic and other aluminosilicate materials, then, include Zeolite beta, Zeolite Y, Ultra Stable Y, ZSM-5, ZSM-12, ZSM-22, ZSM-23, ZSM-48, MCM-68, ZSM-35, SSZ-32, ferrierite, mordenite and silica-aluminophosphates such as SAPO-11 and SAPO-31. Examples of suitable hydroconversion/hydroisomerisation catalysts are, for instance, described in WO-A-9201657. Combinations of these catalysts are also possible.

Suitable hydroconversion/hydroisomerisation processes are those involving a first step wherein a zeolite beta or ZSM-48 based catalyst is used and a second step wherein a ZSM-5, ZSM-12, ZSM-22, ZSM-23, ZSM-48, MCM-68, ZSM-35, SSZ-32, ferrierite or mordenite based catalyst is used. Of the latter group ZSM-23, ZSM-22 and ZSM-48 are preferred. Examples of such processes are described in US-A-20040065581, which discloses the use of a first step catalyst comprising platinum and zeolite beta and a second step catalyst comprising platinum and ZSM-48.

Combination processes in which the Fischer-Tropsch product is first subjected to a first hydroisomerisation step using an amorphous catalyst comprising a silica-alumina carrier as described above, followed by a second hydroisomerisation step using a catalyst which comprises a molecular sieve, have also been identified as preferred processes by which to prepare a base oil for use in the present invention. Preferably the first and second hydroisomerisation steps are performed in series flow. More preferably the two steps are performed in a single reactor comprising beds of the above amorphous and/or crystalline catalysts.

In step (a) the Fischer-Tropsch feed is contacted with hydrogen in the presence of the catalyst at elevated temperature and pressure. The temperature will typically be in the range from 175 to 380° C., preferably higher than 250° C. and more preferably from 300 to 370° C. The pressure will typically be in the range from 10 to 250 bar and preferably from 20 to 80 bar. Hydrogen may be supplied at a gas hourly space velocity of from 100 to 10000 Nl/l/hr, preferably from 500 to 5000 Nl/l/hr. The hydrocarbon feed may be provided at a weight hourly space velocity of from 0.1 to 5 kg/l/hr, preferably higher than 0.5 kg/l/hr and more preferably lower than 2 kg/l/hr. The ratio of hydrogen to hydrocarbon feed may range from 100 to 5000 Nl/kg and is preferably from 250 to 2500 Nl/kg.

The conversion in step (a), defined as the weight percentage of the feed boiling above 370° C. which reacts per pass to a fraction boiling below 370° C., is suitably at least 20 wt %, preferably at least 25 wt %, but preferably not more than 80 wt % and more preferably not more than 65 or 70 wt %. The feed as used in the above definition is the total hydrocarbon feed to step (a), thus including any optional recycle to step (a), for instance of a high boiling fraction which may be obtained in step (b).

In step (b), the product of step (a) is preferably separated into one or more distillate fuel fractions and a base oil or base oil precursor fraction having the desired viscosity. If the pour point of the base oil or precursor is not in the desired range it may be further reduced by means of a dewaxing step (c), preferably by catalytic dewaxing. In such an embodiment it may be a further advantage to dewax a wider boiling fraction of the product of step (a). From the resulting dewaxed product the desired base oil and optionally other oils having desired viscosities can then be isolated for instance by distillation. Dewaxing is preferably performed by catalytic dewaxing, as for example described in WO-A-02070627, which publication is hereby incorporated by reference (see in particular page 8 line 27 to page 11 line 6 for examples of suitable dewaxing conditions and catalysts) and further in the description below. The final boiling point of the feed to the dewaxing step (c) may be the final boiling point of the product of step (a) or lower if desired.

Prior to use in a formulation according to the invention, for instance after a dewaxing step (c), the base oil may be subjected to one or more further treatments such as hydrofinishing, as described for example at page 11 line 7 to page 12 line 12 of WO-A-02070627.

A suitable general process for the production of a Fischer-Tropsch derived base oil is for instance that described in WO-A-02070627. Other suitable processes for the production of heavy and extra heavy Fischer-Tropsch derived base oils are described in WO-A-2004033607, U.S. Pat. No. 7,053,254, EP-A-1366134, EP-A-1382639, EP-A-1516038, EP-A-1534801, WO-A-2004003113 and WO-A-2005063941.

In order to prepare a paraffinic extra heavy base oil for use in the present invention, a Fischer-Tropsch derived bottoms product is suitably subjected to an isomerisation process. This converts n- to iso-paraffins, thus increasing the degree of branching in the hydrocarbon molecules and improving cold flow properties. Depending on the catalysts and isomerisation conditions used, it can result in long chain hydrocarbon molecules having relatively highly branched end regions. Such molecules tend to exhibit relatively good cold flow performance.

The isomerised bottoms product may undergo further downstream processes, for example hydrocracking, hydrotreating and/or hydrofinishing. It is preferably subjected to a dewaxing step, either by solvent or more preferably by catalytic dewaxing, as described above, which serves further to reduce its pour point.

A Fischer-Tropsch derived extra heavy base oil for use in a grease formulation according to the invention is preferably a heavy bottom distillate fraction obtained from a Fischer-Tropsch derived wax or waxy raffinate feed by:

(a) hydrocracking/hydroisomerising a Fischer-Tropsch derived feed, wherein at least 20 wt % of compounds in the Fischer-Tropsch derived feed have at least 30 carbon atoms;

(b) separating the product of step (a) into one or more distillate fraction(s) and a residual heavy fraction comprising at least 10 wt % of compounds boiling above 540° C.;

(c) subjecting the residual fraction to a catalytic pour point reducing step; and (d) isolating from the effluent of step (c), as a residual heavy fraction, the Fischer-Tropsch derived paraffinic heavy base oil component.

In addition to isomerisation and fractionation, the Fischer-Tropsch derived product fractions may undergo various other operations, such as hydrocracking, hydrotreating and/or hydrofinishing.

The feed from step (a) is a Fischer-Tropsch derived product. Its initial boiling point may be up to 400° C., but is preferably below 200° C. Preferably any compounds having 4 or fewer carbon atoms and any compounds having a boiling point in that range are separated from a Fischer-Tropsch synthesis product before the Fischer-Tropsch synthesis product is used in the hydroisomerisation step. An example of a suitable Fischer-Tropsch process is described in WO-A-9934917 and in AU-A-698391. The disclosed processes yield a Fischer-Tropsch product as described above.

The Fischer-Tropsch product directly obtained from a Fischer-Tropsch process contains a waxy fraction that is normally a solid at room temperature.

Again the hydrocracking/hydroisomerisation reaction of step (a) is preferably performed in the presence of hydrogen and a catalyst, for example a catalyst of the type described above. Catalysts for use in the hydroisomerisation typically comprise an acidic functionality and a hydrogenation-dehydrogenation functionality. Preferred acidic functionalities are refractory metal oxide carriers. Suitable carrier materials include silica, alumina, silica-alumina, zirconia, titania and mixtures thereof. Preferred carrier materials for inclusion in the catalyst are silica, alumina and silica-alumina. A particularly preferred catalyst comprises platinum supported on a silica-alumina carrier. Preferably the catalyst does not contain a halogen compound, such as for example fluorine, because the use of such catalysts can require special operating conditions and can involve environmental problems. Examples of suitable hydrocracking/hydroisomerisation processes and catalysts are described in WO-A-0014179, EP-A-532118, EP-A-666894 and the earlier referred to EP-A-776959.

Preferred hydrogenation-dehydrogenation functionalities are Group VIII metals, for example cobalt, nickel, palladium and platinum, more preferably platinum. In the case of platinum and palladium the catalyst may comprise the hydrogenation-dehydrogenation active component in an amount of from 0.005 to 5 parts by weight, preferably from 0.02 to 2 parts by weight, per 100 parts by weight of carrier material. In case nickel is used a higher content will typically be present, and optionally the nickel is used in combination with copper. A particularly preferred catalyst for use in the hydroconversion stage comprises platinum in an amount in the range of from 0.05 to 2 parts by weight, more preferably from 0.1 to 1 parts by weight, per 100 parts by weight of carrier material. The catalyst may also comprise a binder to enhance the strength of the catalyst. The binder can be non-acidic. Examples are clays and other binders known to one skilled in the art.

Other features of the hydroisomerisation step (a) may be as described above.

The product of the hydroisomerisation process preferably contains at least 50 wt % of iso-paraffins, more preferably at least 60 wt %, yet more preferably at least 70 wt %, the remainder being composed of n-paraffins and naphthenic compounds.

In step (b), the product of step (a) is separated into one or more distillate fraction(s) and a residual heavy fraction comprising at least 10 wt % of compounds boiling above 540° C. This is conveniently done by performing one or more distillate separations on the effluent of the hydroisomerisation step to obtain at least one middle distillate fuel fraction and a residual fraction which is to be used in step (c).

Preferably the effluent from step (a) is first subjected to an atmospheric distillation. The residue as obtained in such a distillation may in certain preferred embodiments be subjected to a further distillation performed at near vacuum conditions to arrive at a fraction having a higher 10 wt % recovery boiling point. The 10 wt % recovery boiling point of the residue may preferably vary between 350 and 550° C. This atmospheric bottom product or residue preferably boils for at least 95 wt % above 370° C.

This fraction may be directly used in step (c) or may be subjected to an additional vacuum distillation suitably performed at a pressure of between 0.001 and 0.1 bar. The feed for step (c) is preferably obtained as the bottom product of such a vacuum distillation.

In step (c), the heavy residual fraction obtained in step (b) is subjected to a catalytic pour point reducing step. Step (c) may be performed using any hydroconversion process which is capable of reducing the wax content to below 50 wt % of its original value. The wax content in the intermediate product is preferably below 35 wt % and more preferably between 5 and 35 wt %, and even more preferably between 10 and 35 wt %. The product as obtained in step (c) preferably has a congealing point of below 80° C. Preferably more than 50 wt % and more preferably more than 70 wt % of the intermediate product boils above the 10 wt % recovery point of the wax feed used in step (a).

Wax contents may be measured according to the following procedure: 1 weight part of the oil fraction under analysis is diluted with 4 parts of a (50/50 vol/vol) mixture of methyl ethyl ketone and toluene, which is subsequently cooled to −20° C. in a refrigerator. The mixture is subsequently filtered at −20° C. The wax is thoroughly washed with cold solvent, removed from the filter, dried and weighed. Where reference is made to oil content, a wt % value is meant which is 100% minus the wax content in wt %.

A possible process for step (c) is the hydroisomerisation process as described above for step (a). It has been found that wax levels may be reduced to the desired level using such catalysts. By varying the severity of the process conditions as described above a skilled person will easily determine the required operating conditions to arrive at the desired wax conversion. However a temperature of between 300 and 330° C. and a weight hourly space velocity of between 0.1 and 5, more preferably between 0.1 and 3, kg of oil per liter of catalyst per hour (kg/l/hr) are especially preferred for optimising the oil yield.

A more preferred class of catalyst, which may be applied in step (c), is the class of dewaxing catalysts. The process conditions applied when using such catalysts should be such that a wax content remains in the oil. In contrast typical catalytic dewaxing processes aim at reducing the wax content to almost zero. Using a dewaxing catalyst comprising a molecular sieve will result in more of the heavy molecules being retained in the dewaxed oil. A more viscous base oil can then be obtained.

The dewaxing catalyst which may be applied in step (c) suitably comprises a molecular sieve, for instance as described above, optionally in combination with a metal having a hydrogenation function, such as the Group VIII metals. Molecular sieves, and more suitably molecular sieves having a pore diameter of between 0.35 and 0.8 nm, have shown a good catalytic ability to reduce the wax content of the wax feed. Suitable zeolites are mordenite, beta, ZSM-5, ZSM-12, ZSM-22, ZSM-23, SSZ-32, ZSM-35, ZSM-48 and combinations of said zeolites, of which ZSM-12 and ZSM-48 are most preferred. Another preferred group of molecular sieves are the silica-aluminaphosphate (SAPO) materials of which SAPO-11 is most preferred as for example described in U.S. Pat. No. 4,859,311. ZSM-5 may optionally be used in its HZSM-5 form in the absence of any Group VIII metal. The other molecular sieves are preferably used in combination with an added Group VIII metal. Suitable Group VIII metals are nickel, cobalt, platinum and palladium. Examples of possible combinations are Pt/ZSM-35, Ni/ZSM-5, Pt/ZSM-23, Pd/ZSM-23, Pt/ZSM-48 and Pt/SAPO-11, or stacked configurations of Pt/zeolite beta and Pt/ZSM-23, Pt/zeolite beta and Pt/ZSM-48 or Pt/zeolite beta and Pt/ZSM-22. Further details and examples of suitable molecular sieves and dewaxing conditions are for example described in WO-A-9718278, U.S. Pat. No. 4,343,692, U.S. Pat. No. 5,053,373, U.S. Pat. No. 5,252,527, US-A-20040065581, U.S. Pat. No. 4,574,043 and EP-A-1029029.

Another preferred class of molecular sieves are those having a relatively low isomerisation selectivity and a high wax conversion selectivity, like ZSM-5 and ferrierite (ZSM-35).

The dewaxing catalyst suitably also comprises a binder. The binder can be a synthetic or naturally occurring (inorganic) substance, for example clay, silica and/or a metal oxide. Natural occurring clays are for example of the montmorillonite and kaolin families. The binder is preferably a porous binder material, for example a refractory oxide of which examples include alumina, silica-alumina, silica-magnesia, silica-zirconia, silica-thoria, silica-beryllia and silica-titania as well as ternary compositions for example silica-alumina-thoria, silica-alumina-zirconia, silica-alumina-magnesia and silica-magnesia-zirconia. More preferably a low acidity refractory oxide binder material, which is essentially free of alumina, is used. Examples of these binder materials are silica, zirconia, titanium dioxide, germanium dioxide, boria and mixtures of two or more of these of which examples are listed above. The most preferred binder is silica.

A preferred class of dewaxing catalysts comprises intermediate zeolite crystallites as described above and a low acidity refractory oxide binder material which is essentially free of alumina as described above, wherein the surface of the aluminosilicate zeolite crystallites has been modified by subjecting the aluminosilicate zeolite crystallites to a surface dealumination treatment. A preferred dealumination treatment involves contacting an extrudate of the binder and the zeolite with an aqueous solution of a fluorosilicate salt as described in for example U.S. Pat. No. 5,157,191 or WO-A-0029511. Examples of suitable dewaxing catalysts as described above are silica bound and dealuminated Pt/ZSM-5, or silica bound and dealuminated Pt/ZSM-35 as for example described in WO-A-0029511 and EP-B-832171.

The conditions in step (c) when using a dewaxing catalyst typically involve operating temperatures in the range of from 200 to 500° C., suitably from 250 to 400° C. Preferably the temperature is between 300 and 330° C. The hydrogen pressures may range from 10 to 200 bar, preferably from 40 to 70 bar. Weight hourly space velocities (WHSV) may range from 0.1 to 10 kg of oil per liter of catalyst per hour (kg/l/hr), suitably from 0.1 to 5 kg/l/hr, more suitably from 0.1 to 3 kg/l/hr. Hydrogen to oil ratios may range from 100 to 2,000 liters of hydrogen per liter of oil.

In step (d), the product of step (c) is usually sent to a vacuum column where the various distillate base oil cuts are collected. These distillate base oil fractions may be used to prepare lubricating base oil blends, or they may be cracked into lower boiling products, such as diesel or naphtha. The residual material collected from the vacuum column comprises a mixture of high boiling hydrocarbons, and can be used to prepare a heavy base oil for use in the present invention.

Furthermore, the product obtained in step (c) may also be subjected to additional treatments, such as solvent dewaxing. The product can be further treated, for example in a clay treating process or by contacting with active carbon, as for example described in U.S. Pat. No. 4,795,546 and EP-A-712922, in order to improve its stability.

The thickener included in a grease formulation according to the invention may be a soap or a non-soap thickener.

Examples of suitable non-soap thickeners include urea compounds, which are compounds containing the urea group (—NHCONH—) in their molecular structure. These compounds include mono-, di-, tri-, tetra- and polyurea compounds, depending upon the number of urea linkages they contain. Other suitable non-soap thickeners include clays treated with an ammonium compound (for example a tetra-alkyl ammonium halide) to render them hydrophobic, in particular bentonite, attapulgite, hectorite, illite, saponite, sepiolite, biotite, vermiculite, zeolite clays and the like; silica gels; polymeric thickeners such as PTFE (polytetrafluoroethane) or hydrocarbon polymers such as polypropylene or polymethylpentene; carbon black; and mixtures thereof.

The thickener may in particular be a soap-based thickener, typically a metal salt of a fatty acid or mixture of fatty acids or in cases other fatty material(s). The soap may for example be an alkali metal salt such as a sodium, potassium or lithium salt, or an alkaline earth metal salt such as a calcium, barium or magnesium salt, or an aluminum salt. It may be selected from lithium, sodium, calcium and aluminum soaps, including mixed salts such as lithium/calcium soaps. It may in particular be a lithium or calcium salt, more particularly a lithium salt.

The soap may be formed by mixing a base such as a metal hydroxide, oxide, carbonate or other such suitable compound with a suitable hydrophobic component, in particular a fatty acid or mixture thereof. The fatty component of the soap will typically have a carbon chain length of $C_{6-30}$ or of $C_{12-30}$, preferably of $C_{6-24}$ or $C_{12-24}$, more preferably of $C_{12-20}$. Where it is a fatty acid, it may contain other functional groups in addition to the carboxylic acid group, in particular a hydroxyl group as in, for example 12-hydroxyoctadecanoic acid. Examples of suitably fatty acids include stearic acid, hydroxystearic acid, oleic acid, palmitic acid, myristic acid, cottonseed oil acids and hydrogenated fish oil acids.

Lithium soap thickened greases, for example, have been known for many years. Typically, the lithium soaps are derived from C10-24, preferably C15-18, saturated or unsaturated fatty acids or derivatives thereof. One such derivative is hydrogenated castor oil, which is the glyceride of 12-hydroxystearic acid and is a particularly preferred fatty acid in the present context.

A soap thickener may be a metal complex soap, containing a metal salt of a fatty acid or mixture thereof and an additional complexing agent which is commonly a low to medium molecular weight acid or dibasic acid or one of its salts, for example benzoic acid, boric acid or a metal borate such as lithium borate. The metal and the fatty acid component may be as described above. The lower molecular weight acid may be a mono-, di- or polycarboxylic acid, or it may be an inorganic acid such as boric acid. It may be used in the form of an acid salt, such as lithium borate. The carboxylic acid may be aromatic or aliphatic and it may contain other functional groups in addition to the carboxylic acid group(s). In particular, a metal complex soap may be selected from lithium complex, calcium complex, aluminum complex and calcium sulphonate complex soaps and mixtures thereof.

Complex thickeners of potential use in a grease formulation according to the invention include for example calcium stearate-acetate (see U.S. Pat. No. 2,197,263), barium stearate-acetate (U.S. Pat. No. 2,564,561), calcium stearate-caprylate-acetate complexes (U.S. Pat. No. 2,999,066), and salts of low, intermediate and high molecular weight acids and of nut oil acids.

Other thickeners which may be of use in a formulation according to the invention include those disclosed in U.S. Pat. No. 5,650,380, WO-A-1999014292, U.S. Pat. No. 6,642,187 and U.S. Pat. No. 5,612,297.

A grease formulation according to the invention may contain more than one thickener.

The formulation suitably contains a relatively high thickener concentration, to compensate for the low polarity of the Fischer-Tropsch derived base oil. It may for example contain 4 wt % or more of the thickener, or 5 or 10 or 15 or even 20 or 21 or 22 wt % or more, based on the overall formulation. It may contain up to 20 or 30 or 35 or 40 wt % of the thickener. A suitable thickener concentration may for instance be in the range from 5 to 35 wt %, such as from 5 to 25 wt %. The thickener concentration will depend on the overall consistency required of the formulation.

For a given viscosity of Fischer-Tropsch derived base oil, a grease formulation according to the invention may contain a higher concentration of thickener than that present in a grease formulation containing the same quantity of a mineral derived base oil having the same viscosity.

Correspondingly, the concentration of the Fischer-Tropsch derived base oil in a formulation according to the invention may for example be 50 wt % or greater, or 60 or 70 or 75 wt % or greater, based on the overall formulation. The formulation may contain up to 80 or 90 or 95 or even 96 wt % of the base oil. A suitable base oil concentration may for instance be in the range from 60 to 95 wt %, such as from 75 to 95 wt %. Again this will depend on the consistency required, a higher base oil concentration such as about 95 wt % yielding a thin, semi-fluid grease and a lower concentration, for example 75 wt % or below, a high consistency, low penetration grease.

In cases, where for example the Fischer-Tropsch derived base oil is only one of two or more base oils present in the formulation, the concentration of the Fischer-Tropsch derived oil in the overall formulation may be from 15 or 20 wt %, for example up to 30 or 40 or 50 or 60 wt %.

A grease formulation according to the invention suitably exhibits a penetration (for instance in the standard test method ASTM D-217) of from 220 to 340, preferably from 250 to 310 or from 265 to 295.

It is preferably lead free.

The grease formulation ideally exhibits a suitable level of mechanical stability, so that it does not become so thin during application that it can be easily removed from the area which it is intended to lubricate. Mechanical stability may be assessed by stability tests such as worked stability and roll stability tests, in which the consistency or penetration of a grease formulation is measured both before and after being subjected to rheological stress; ideally, the grease penetration should change only a little after such treatment. For example, in the penetration stability test after 100,000 strokes in the grease worker, according to ASTM D-217, the penetration value of the grease formulation preferably changes by less than 30 points, more preferably by less than 25 or 20 or 15 or 10 or even 5 points; a smaller change in penetration value in this test indicates a greater mechanical stability.

A grease formulation according to the invention preferably exhibits stability at elevated temperature and under oxidation conditions. This may be assessed by, for example, an oxidation test in which the uptake of oxygen is measured at 99° C. over a period of 100 hours or more. For example, in the Norma Hoffmann "bomb" oxidation test for greases according to ASTM D-942, the pressure drop for a grease formulation according to the invention, after 100 hours, is preferably 35 kilopascals or less, more preferably 30 or 25 or even 20 kilopascals or less; a smaller pressure drop in this test indicates a greater oxidative stability.

The formulation is advantageously light (e.g. white to light beige) in colour, making it more pleasant to use and in a variety of applications where staining from darker greases could be an issue. In this context the present invention can provide additional benefits, since Fischer-Tropsch derived base oils tend to be generally lighter in colour than their mineral derived counterparts, and to exhibit less variation in colour than conventional mineral oils. Even with additives present, a grease formulation according to the invention will typically be lighter in colour than an analogous formulation based on a mineral derived oil. Moreover the reduced additive levels made possible by the present invention can also help to lighten the colour of the overall grease formulation and to reduce colour variations.

Thus a grease formulation according to the invention may suitably have a colour, as assessed according to the colour scale of ASTM D-1500, of between 0 and 1.5 (colourless ("water-white") to light beige), preferably between 0 and 1 or between 0 and 0.5. The Fischer-Tropsch derived base oil used in the formulation also suitably has an ASTM D-1500 colour of between 0 and 1.5, preferably between 0 and 1 or between 0 and 0.5. Conventional mineral oil-based greases, particularly those containing additives, are typically much darker in colour, having ASTM D-1500 values of from 1 to, in certain cases, 7 (dark brown).

A grease formulation according to the invention preferably also exhibits good lubricant properties such as anti-wear characteristics, extreme-pressure properties and anti-fretting capability. Such properties may be assessed using dedicated test methods such as the four ball wear test, the four ball extreme pressure (EP) test (weld load) and the Fafnir fretting test. For example, in a four ball wear test according to ASTM D-2266 or IP 239, a grease formulation according to the invention preferably produces a wear scar diameter of 0.6 or 0.5 mm or less, a lower diameter in such a test indicating improved anti-wear properties. Furthermore, in the four ball EP test according to ASTM D-2596, a grease formulation according to the invention preferably produces a weld load of 250 kg or more, indicating good extreme pressure properties. Still further, in the Fafnir fretting test according to ASTM D-4170, a grease formulation according to the invention preferably results in a wear of 10 mg or less, indicating good anti-fretting properties.

The formulation may contain other components in addition to the Fischer-Tropsch derived base oil and the thickener. It may for example contain additives to enhance its oxidation resistance (antioxidant additives), its resistance to corrosion on copper-based metals (copper corrosion additives), its resistance to rust through the action of water on steel (rust inhibitors), its anti-wear and extreme pressure characteristics (for example anti-wear additives), its friction characteristics, its fretting characteristics, its high temperature resistance and/or its adhesiveness or tackiness. The nature and quantity of any such additives will depend on the intended use of the formulation and the properties and performance required of it.

Unless otherwise stated, the concentration of each such additional component in the grease formulation is preferably up to 10 wt %, for example from 0.01 to 10 wt % or from 0.01 to 5 or 4 or 3 or 2 or 1 or 0.5 wt %. The total additive content in the formulation may suitably be from 1 to 10 wt %, preferably below 5 wt %. (All additive concentrations quoted in this specification refer, unless otherwise stated, to active matter concentrations by mass. Further, all concentrations, unless otherwise stated, are quoted as percentages of the overall grease formulation.)

If desired one or more additive components, such as those listed above, may be co-mixed—preferably together with suitable diluent(s)—in an additive concentrate, and the additive concentrate may then be dispersed into the base oil or a base oil/thickener mixture, in order to prepare a grease formulation according to the invention.

Due to the beneficial effects of incorporating the Fischer-Tropsch derived base oil—some of which are entirely unexpected—a grease formulation according to the invention may contain lower levels of additives than other more conventional, in particular mineral oil-based, grease formulations. A formulation according to the invention may for example contain 50,000 ppmw or less of additives, in cases 40,000 or 30,000 or 20,000 or 10,000 ppmw or less, or even 5,000 or 2,000 or 1,000 ppmw or less. In an embodiment, the formulation contains substantially no additives (by which is meant it contains less than 100 ppmw of additives), and is ideally additive-free.

In particular, the formulation may contain low levels of, or suitably no, anti-wear additives, as described below in connection with the fourth aspect of the invention. Thus for example, the formulation may contain less than 2 wt % of anti-wear additives, suitably less than 1 wt % or even less than 0.5 wt %. In cases it may contain no anti-wear additives at all.

Similarly, the formulation may contain low levels of, or suitably no, copper corrosion additives, as described below in connection with the fifth aspect of the invention. Thus for example, the formulation may contain less than 0.3 or 0.2 wt % of copper corrosion additives, suitably less than 0.1 or 0.05 wt %. In cases it may contain no copper corrosion additives at all.

The formulation may contain low levels of, or suitably no, antioxidant additives, as described below in connection with the sixth aspect of the invention. Thus for example, it may contain less than 1 wt % of antioxidant additives, suitably less than 0.5 or 0.3 wt %. In cases it may contain no antioxidant additives at all.

The formulation may contain low levels of, or suitably no, viscosity modifying additives, as described below in connection with the seventh aspect of the invention. For example it may contain less than 1 wt % of viscosity modifying additives, suitably less than 0.5 or 0.1 wt %. In cases it may contain no viscosity modifying additives at all.

The formulation may contain low levels of, or suitably no, cold flow additives (for example pour point depressants), as described below in connection with the eighth aspect of the invention. Thus for example, it may contain less than 0.5 wt % of cold flow additives, in particular pour point depressants, suitably less than 0.1 or 0.05 wt %. In cases it may contain no cold flow additives at all.

According to a second aspect of the present invention, there is provided the use of a Fischer-Tropsch derived base oil in a grease formulation, for the purpose of improving the anti-wear performance of the formulation.

The anti-wear performance of a grease formulation can suitably be assessed using a standard test method such as ASTM D-2596, IP 239, DIN 51350 or an analogous technique, for example using a wear test such as the four ball wear test.

In general, an improvement in anti-wear performance may be manifested by a reduction in wear scarring (which may be a reduction in the amount of and/or depth of scarring) on two relatively moving components, the surfaces of which are covered with a grease formulation under test. Thus for example in a test such as the four ball wear test, a reduced diameter of wear scarring on the surfaces of the stationary balls, after a predetermined period of time, indicates a better anti-wear performance. An improvement in anti-wear performance may be manifested by an increase in the usable lifetime of equipment which a grease formulation is used to lubricate, and/or by a reduction in wear scarring or similar damage between relatively moving parts of the equipment.

An improvement in anti-wear performance may instead or in addition be manifested by a reduction in fretting in for example the standard test method ASTM D-4170, and/or by an improved performance in a bearing leakage test such as ASTM D-1263.

In the context of the second aspect of the invention, "improving" the anti-wear performance of the grease formulation embraces any degree of improvement compared to the performance of the formulation before the Fischer-Tropsch derived base oil is incorporated, or compared to that of an otherwise analogous formulation containing a non-Fischer-Tropsch derived base oil. This may for example involve adjusting the anti-wear performance of the formulation, by means of the Fischer-Tropsch derived base oil, in order to meet a desired target.

A grease formulation prepared according to the invention suitably yields a wear scar diameter, in the four ball wear test after one hour with an applied load of 40 kg (the top ball rotating at 1300 rpm and the operating temperature being 75° C.), of 0.8 mm or lower. It may yield a wear scar diameter, under the above described test conditions, of 0.7 or 0.6 or 0.5 or 0.4 mm or lower. Preferably it yields such results in the absence of anti-wear additives, or at least in the presence of only low levels of such additives, as described above.

According to a third aspect of the invention, there is provided the use of a Fischer-Tropsch derived base oil in a grease formulation, for the purpose of improving the copper corrosion performance of the formulation.

The copper corrosion performance of a grease formulation is a measure of how quickly it produces staining on a copper surface with which it is in contact, and is typically measured at an elevated temperature, for example at 100° C., for a period of several hours or even days. It may for instance be assessed using the standard test method ASTM D-130 or an analogous technique. An improvement in copper corrosion performance may be manifested by a reduced amount of staining on a copper surface which has been exposed to the grease formulation under such conditions, suitably for 3 or 5 or 10 hours or more, or even for 12 or 24 hours or more.

In the context of the third aspect of the invention, "improving" the copper corrosion performance of the grease formulation embraces any degree of improvement compared to the performance of the formulation before the Fischer-Tropsch derived base oil is incorporated, or compared to that of an otherwise analogous formulation containing a non-Fischer-Tropsch derived base oil. This may for example involve adjusting the copper corrosion performance of the formulation, by means of the Fischer-Tropsch derived base oil, in order to meet a desired target.

A grease formulation prepared according to the invention suitably yields a copper corrosion performance, in the ASTM D-130 test at 100° C. for 24 hours, of 1b or lower. It may yield a result, under the above described test conditions, of 1a. It may yield a result of 1b or lower, such as of 1a, when subjected to the ASTM D-130 test for 24 hours at 120° C. or higher. Preferably it yields such results in the absence of copper corrosion additives, or at least in the presence of only low levels of such additives, as described above.

Instead of or in addition to (suitably in addition to) its use for the purpose of improving the anti-wear performance and/or the copper corrosion performance of the formulation, the Fischer-Tropsch derived base oil may be used for one or more of the following purposes:

i) improving the oxidation stability of the formulation;
ii) improving the cold flow properties of the formulation;
iii) improving the rust resistance of the formulation;
iv) improving the load carrying performance of the formulation, as measured for instance using the standard test method ASTM D-2596 (four ball weld load test);
v) improving the mechanical stability of the formulation;
vi) improving the oil separation tendency of the formulation.

In particular the Fischer-Tropsch derived base oil may be used for the purpose of improving the rust resistance of the formulation.

The above properties typically need to be monitored and adjusted in order for a grease formulation to meet current performance specifications, and/or to satisfy consumer demand. For example, a certain level of cold flow performance (for example, a maximum pour point) may be desirable to meet relevant specifications, as may a certain minimum kinematic viscosity, a certain level of stability against oxidation, and/or a certain level of mechanical stability. According to the present invention, such standards may all be achievable simultaneously, often with reduced levels of or even no additives present, due to the inclusion of the Fischer-Tropsch derived base oil.

The oxidation stability of a grease formulation may be measured using a standard method such as ASTM D-942 or an analogous method. "Improving" the oxidation stability of a grease formulation embraces any degree of improvement compared to the oxidation stability of the formulation before the Fischer-Tropsch derived base oil is incorporated, or compared to that of an otherwise analogous formulation containing a non-Fischer-Tropsch derived base oil. This may for example involve adjusting the oxidation stability of the formulation, by means of the Fischer-Tropsch derived base oil, in order to meet or exceed a desired target.

The cold flow properties of a grease formulation may reflect its ease of handling at low temperatures, for example at 0° C. or lower. This may be assessed using tests such as low temperature torque (ASTM D-4693) or flow pressure (DIN 51805) tests. "Improving" the cold flow properties of a grease formulation embraces any degree of improvement compared to the cold flow properties of the formulation before the Fischer-Tropsch derived base oil is incorporated, or compared to those of an otherwise analogous formulation containing a non-Fischer-Tropsch derived base oil. This may for example involve adjusting the cold flow properties of the formulation, by means of the Fischer-Tropsch derived base oil, in order to meet or exceed a desired target.

The rust resistance of a grease formulation may be measured using a standard method such as IP 220 or an analogous method. "Improving" the rust resistance of a grease formulation embraces any degree of improvement compared to the rust resistance of the formulation before the Fischer-Tropsch derived base oil is incorporated, or compared to those of an otherwise analogous formulation containing a non-Fischer-Tropsch derived base oil. This may for example involve adjusting the rust resistance of the formulation, by means of the Fischer-Tropsch derived base oil, in order to meet or exceed a desired target.

The mechanical stability of a grease formulation may be measured using a standard method such as ASTM D-1831 or an analogous method. "Improving" the mechanical stability of a grease formulation embraces any degree of improvement compared to the mechanical stability of the formulation before the Fischer-Tropsch derived base oil is incorporated, or compared to that of an otherwise analogous formulation containing a non-Fischer-Tropsch derived base oil. This may for example involve adjusting the mechanical stability of the formulation, by means of the Fischer-Tropsch derived base oil, in order to meet or exceed a desired target.

The oil separation tendency of a grease formulation may be measured using a standard method such as IP 121 or an analogous method. "Improving" the oil separation tendency of a grease formulation embraces any degree of improvement compared to the oil separation tendency of the formulation before the Fischer-Tropsch derived base oil is incorporated, or compared to that of an otherwise analogous formulation containing a non-Fischer-Tropsch derived base oil. This may for example involve adjusting the oil separation tendency of the formulation, by means of the Fischer-Tropsch derived base oil, in order to meet or exceed a desired target.

In the context of the present invention, "use" of a Fischer-Tropsch derived base oil in a grease formulation means incorporating the base oil into the formulation, typically as a blend (i.e. a physical mixture) with one or more thickeners and optionally with one or more additives such as those described above.

Such use may also embrace supplying a Fischer-Tropsch derived base oil together with instructions for its use in a grease formulation to achieve the purpose(s) of the second and/or third aspects of the invention, for instance to achieve a desired target level of anti-wear performance or copper corrosion performance, and/or a desired target level of rust resistance, and/or a desired target level of oxidation stability, and/or a desired target viscosity, and/or a desired target cold flow property, and/or to reduce the concentration of an additive in the formulation.

As described above, the presence of a Fischer-Tropsch derived base oil in a grease formulation, in accordance with the invention, can lead to an unexpected enhancement of the anti-wear performance of the formulation. This in turn can allow the use of lower concentrations of anti-wear additives, or in cases can remove the need for such additives altogether. In other words, inclusion of the Fischer-Tropsch derived base oil potentially enables lower levels of anti-wear additives to be used in a grease formulation in order to achieve a desired target level of anti-wear performance.

Thus according to a fourth aspect, the invention provides the use of a Fischer-Tropsch derived base oil in a grease formulation, for the purpose of reducing the concentration of an anti-wear additive in the formulation.

An anti-wear additive may be defined as an additive which improves the anti-wear characteristics of a lubricant or grease formulation. Examples of known anti-wear additives for use in grease formulations include metal dialkyldithiophosphates, metal dialkyldithiocarbamates, metal-free dialkyldithiophosphates, metal-free dialkyldithiocarbamates, full or partial esters of phosphoric acid and full or partial esters of boric acid.

In the context of this fourth aspect of the invention, the term "reducing" embraces any degree of reduction—for instance 10% or more of the original anti-wear additive concentration, preferably 15 or 20 or 25% or more. The reduction may for instance be from 10 to 75% of the original anti-wear additive concentration, or from 25 to 50%. In cases the reduction may be 100%, i.e. reduction to an anti-wear additive concentration of zero. The reduction may be as compared to the concentration of the relevant additive which would otherwise have been incorporated into the grease formulation in order to achieve the properties and performance required or desired of it in the context of its intended use. This may for instance be the concentration of the additive which was present in the formulation prior to the realisation that a Fischer-Tropsch derived base oil could be used in the way provided by the present invention, or which was present in an otherwise analogous formulation intended (e.g. marketed) for use in an analogous context, prior to adding a Fischer-Tropsch derived base oil to it, or which was present in an otherwise analogous formulation containing a non-Fischer-Tropsch derived (in particular mineral derived) base oil.

The (active matter) concentration of the anti-wear additive in a grease formulation prepared according to the invention may be 10,000 ppmw or less, preferably 8000 or 5000 ppmw or less, for example from 5000 to 1000 ppmw. The formulation may contain no or substantially no anti-wear additives.

The inclusion of a Fischer-Tropsch derived base oil, together with a correspondingly high thickener concentration, can provide additional benefits in a grease formulation, as described above. This in turn can allow the use of lower levels of other grease additives than in more conventional, mineral-based formulations.

According to a fifth aspect, for instance, the invention provides the use of a Fischer-Tropsch derived base oil in a grease formulation, for the purpose of reducing the concentration of a copper corrosion additive in the formulation.

A copper corrosion additive may be defined as an additive which enhances the copper corrosion performance of a lubricant or grease formulation. Examples of known copper corrosion additives for use in grease formulations include benzotriazole, toluotriazole and zinc oxide.

The (active matter) concentration of the copper corrosion additive in a grease formulation prepared according to the invention may be 500 ppmw or less, preferably 250 ppmw or less, for example from 250 to 100 ppmw. The formulation may contain no or substantially no copper corrosion additives.

A sixth aspect of the invention provides the use of a Fischer-Tropsch derived base oil in a grease formulation, for the purpose of reducing the concentration of an antioxidant additive in the formulation.

An antioxidant additive may be defined as an additive which reduces the tendency of a grease formulation, or any of its components, to oxidise, including via an autoxidation process, and/or which improves the storage stability of the formulation in the presence of oxygen. Examples of known antioxidant additives for use in grease formulations include organic amine compounds, particularly diphenylamine and substituted diphenylamine, phenyl-alpha-naphthylamine and substituted phenylealpha-naphthylamine; quinoline compounds such as polymerised trimethyldihydroquinoline; organic phenol compounds and organic sulphur compounds.

The (active matter) concentration of the antioxidant additive in a grease formulation prepared according to the invention may be 5000 ppmw or less, preferably 2500 ppmw or less, for example from 2500 to 500 ppmw. The formulation may contain no or substantially no antioxidant additives.

A seventh aspect of the invention provides the use of a Fischer-Tropsch derived base oil in a grease formulation, for the purpose of reducing the concentration of a viscosity modifying additive in the formulation.

A viscosity modifying additive may be defined as an additive which lowers the rate of change of viscosity of a fluid with temperature. Examples of known viscosity modifying additives for use in grease formulations include hydrocarbon polymers such as ethylene-propylene polymers, ethylene-propylene-diene-monomer polymers and acrylate polymers.

The (active matter) concentration of the viscosity modifying additive in a grease formulation prepared according to the invention may be 1000 ppmw or less, preferably 500 or 250 ppmw or less, for example from 250 to 50 ppmw. The formulation preferably contains no or substantially no viscosity modifying additives.

An eighth aspect of the invention provides the use of a Fischer-Tropsch derived base oil in a grease formulation, for the purpose of reducing the concentration of a cold flow or flow improver additive in the formulation.

A cold flow additive may be defined as any material capable of improving the cold flow properties of the formulation, as described above. A flow improver additive is a material capable of improving the ability or tendency of the formulation to flow at any given temperature.

Known cold flow additives include for example polyalkylmethacrylates, of various molecular weights and structures.

The (active matter) concentration of the cold flow additive in a grease formulation prepared according to the invention may be up to 250 ppmw, preferably up to 100 ppmw. Its (active matter) concentration will suitably be at least 10 ppmw, preferably at least 50 ppmw. The formulation may contain no or substantially no cold flow additives.

A ninth aspect provides the use of a Fischer-Tropsch derived base oil in a grease formulation, for the purpose of reducing the concentration of an anti-rust additive in the formulation.

An anti-rust additive may be defined as an additive which improves the resistance provided by a lubricant or grease formulation to rusting of a steel or iron surface which is in contact with water but protected by a film of the lubricant or grease formulation. Examples of known anti-rust additives for use in grease formulations include neutral metal organic sulphonates; overbased metal organic sulphonates; metal naphthenates; metal salts of monobasic, dibasic and polybasic carboxylic acids; and alkylsuccinic acid reaction products.

The (active matter) concentration of the anti-rust additive in a grease formulation prepared according to the invention may be 5000 ppmw or less, preferably 2000 ppmw or less, for example from 2000 to 500 ppmw. The formulation may contain no or substantially no anti-rust additives.

In the context of the fifth to the ninth aspects of the invention, the term "reducing" has a similar meaning as in the context of the fourth aspect, mutatis mutandis.

A tenth aspect of the invention provides the use of a Fischer-Tropsch derived base oil in a grease formulation containing a thickener, for the purpose of increasing the concentration of the thickener, in order thereby to achieve one or more of the advantages described above in connection with the second to the ninth aspects of the invention.

According to an eleventh aspect, the invention provides a method for preparing a grease formulation, such as a grease formulation according to the first aspect, the method comprising mixing together a thickener and a Fischer-Tropsch derived base oil, optionally with one or more additives. The method may be carried out for one or more of the purposes described above in connection with the second to the tenth aspects of the invention. Other preferred features of this aspect of the invention may be as described above in connection with the first to the tenth aspects: in particular, the thickener may comprise a soap.

The method of the eleventh aspect may involve manufacturing a thickener, for example a soap-based thickener, in a Fischer-Tropsch derived base oil, and subsequently incorporating any desired additives into the resultant mixture.

A twelfth aspect provides a method of running an item of mechanical equipment which involves the use, as a lubricant in the equipment, of a grease formulation according to the first aspect of the invention, and/or a grease formulation prepared according to any one of the second to the eleventh aspects. The grease formulation may be used in the equipment so as to benefit from one or more of the advantages described above. The item of equipment may for example be a rolling element bearing, such as in an automobile wheel hub; an industrial machine; an electric motor; a transmission joint such as a constant velocity joint; a steering joint or cardan shaft in an automobile; or a gear assembly such as a drive gear on a conveyor.

According to a thirteenth aspect, the invention provides an item of mechanical equipment which contains a grease formulation according to the first aspect and/or a grease formulation prepared according to any one of the second to the eleventh aspects.

Throughout the description and claims of this specification, the words "comprise" and "contain" and variations of the words, for example "comprising" and "comprises", mean "including but not limited to", and are not intended to (and do not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Preferred features of each aspect of the invention may be as described in connection with any of the other aspects.

Other features of the present invention will become apparent from the following examples. Generally speaking the invention extends to any novel one, or any novel combination, of the features disclosed in this specification (including any accompanying claims and drawings). Thus features, integers, characteristics, compounds, chemical moieties or groups described in conjunction with a particular aspect, embodiment or example of the invention are to be understood to be applicable to any other aspect, embodiment or example described herein unless incompatible therewith.

Moreover unless stated otherwise, any feature disclosed herein may be replaced by an alternative feature serving the same or a similar purpose.

The following examples illustrate the properties and performance of grease formulations in accordance with the invention.

EXAMPLES

Lithium grease formulations according to the invention were prepared, and their properties tested and compared with those of standard commercially available mineral oil-based greases.

Each of the formulations contained a major proportion of a Fischer-Tropsch derived base oil. The two base oils used, BO-1 and BO-2, had the properties shown in Table 1 below. They had been prepared using Fischer-Tropsch processes analogous to those described above.

TABLE 1

| Property | Test method | Units | BO-1 | BO-2 |
|---|---|---|---|---|
| Kinematic viscosity at 40° C. | ASTM D-445 | $mm^2/s$ | 132 | 43.88 |
| Kinematic viscosity at 100° C. | ASTM D-445 | $mm^2/s$ | 19 | 7.77 |
| Viscosity index | ASTM D-2270 | | 163 | 148 |
| Digital density @ 15° C. | IP 365/97 | $kg/m^3$ | 834.1 | 827.5 |
| NOACK evaporation | CEC L-40-A-93 | Wt % | | 2.3 |
| Flash point D-92 | ASTM D-92 | ° C. | 284 | 274 |
| Flash point D-93 | ASTM D-93 | ° C. | 247.5 | 238.5 |
| Pour point | ASTM D-5950 | ° C. | −30 | −24 |
| Colour | ASTM D-1500 | | L0.5 | L1.0 |
| Appearance | | | Hazy pale yellow | Clear & bright; pale brown |

It can be seen that the Fischer-Tropsch derived base oils have high viscosity indices, low pour points (in the case of the heavy base oil BO-1, for instance, about 10 or 20° C. lower than a typical mineral derived "Group I" base oil), high flash points and low evaporation rates (potentially beneficial for stability under higher temperature operating conditions). Although the heaviest oil BO-1 is slightly cloudy in appearance, due to the presence of a small number of residual wax crystals which are not removed during its production, this is not a problem in grease formulations and is not believed to affect the properties of the final product. Because of this cloudiness, however, the viscosity of BO-1 could not be measured accurately at 40° C.; the value quoted in Table 1 is therefore calculated from values taken at 100 and 70° C.

Example 1

A lithium grease formulation GF-1, containing the base oil BO-1, was prepared using a standard Pretzsch kettle procedure.

1100 g of the base oil, 330 g of hydrogenated castor oil and 46.2 g lithium hydroxide were placed in a Pretzsch kettle with 50 g of water. This mixture was heated in the sealed kettle, under stirring, to approximately 150° C. The steam was vented off and heating continued to approximately 220° C. The reaction mass was then cooled.

From 200 to 165° C., cooling took place at a rate of 1° C. per minute. At a charge temperature of 163° C., 723.8 g of the base oil was added over 10 minutes. The oil cooler was then switched on. Once the grease had cooled to room temperature it was homogenised, for instance by being passed once through a three-roll mill.

The finished formulation GF-1 was a light beige grease containing 82.9 wt % of the base oil, 15 wt % of hydrogenated castor oil and 2.1 wt % of lithium hydroxide. The overall soap content was close to that predicted to be necessary to produce a grease with penetration around 280, based on polarity and viscosity data for the oil.

GF-1 did not contain any performance enhancing additives.

A number of relevant properties of the grease formulation GF-1 were measured using standard test methods as well as a number of additional test procedures. The same properties were also measured for a commercially available mineral oil-based grease formulation GF-A (ex-Shell). The results are shown in Table 2 below.

TABLE 2

| Property | Test conditions | Test method | GF-1 | GF-A |
|---|---|---|---|---|
| Base fluid | | | BO-1 | SN500 mineral oil |
| Thickener content (wt %) | | — | 15 | 9 |
| Penetration | Undisturbed | ASTM D-217 | 275 | 273 |
| | 60 strokes | ASTM D-217 | 286 | 279 |
| | Difference | | 11 | 6 |
| | 100,000 strokes | ASTM D-217 | 290 | 307 |
| | Difference | | 4 | 28 |
| Dropping point (° C.) | Mettler automatic | IP 396 | 199.3 | 189 |
| Roll stability (difference in penetration) | 18 hrs, 65° C. | ASTM D-1831 | 313 | 358 |
| | Difference | | 27 | 79 |
| | 50 hrs, 80° C. | ASTM D-1831 | 327 | |
| | Difference | | 41 | |
| | 100 hrs, 100° C. | ASTM D-1831 | 341 | 409 |
| | Difference | | 55 | 130 |
| Oil separation (% m/m) | 40° C., 18 hrs | IP 121 | 1.3 | 2.1 |
| | 40° C., 7 days | IP 121 | 2.47 | 6 |
| | 80° C., 18 hrs | IP 121 | 2.9 | |
| | 80° C., 7 days | IP 121 | 6.84 | |
| Water washout, 79° C. (% m/m) | | ASTM D-1264 | 3.7 | |

TABLE 2-continued

| Property | Test conditions | Test method | GF-1 | GF-A |
|---|---|---|---|---|
| 4-ball wear test (mm) | Wear, 40 kg, 1 hour | IP 239 | 0.41 | 0.42 |
| Copper corrosion, 24 hr (rating) | 100° C. | ASTM D-130 | 1a | 1a |
| | 125° C. | ASTM D-130 | 1a | |
| | 150° C. | ASTM D-130 | 1a | |
| Emcor rust test (rating) | Distilled water | IP 220 | 0 | 0 |
| Oxidation stability (kPa) | 100 hrs | ASTM D-942 | 17.5 | 17 to 28 |
| | 400 hrs | ASTM D-942 | 47.5 | 41 to 52 |
| Wheel bearing leakage | 130° C. for 6 hrs | ASTM D-1263 | 1.05 g | |

The yield for GF-1 (i.e. the amount of thickener needed to achieve a certain consistency or penetration value) was significantly lower than for the conventional mineral oil grease, which confirmed predictions based on the lower polarity of the Fischer-Tropsch base oil. Fischer-Tropsch derived oils are known to require up to 75% more thickener than typical mineral-derived "Group I" base oils.

A higher thickener content is also known to lead to improved mechanical stability and lower oil separation. This is confirmed by the Table 2 data, which show the stability and oil separation of GF-1 to far exceed those of the conventional mineral oil-based grease. Indeed, the oil separation for GF-1 at 80° C. is approximately equivalent to that of a conventional lithium grease at 40° C. These stability and oil separation benefits are reflected in the result of the wheel bearing leakage test at 130° C., the performance of GF-1 being as would normally be expected from a good complex grease. These results are better than expected due to the use of a Fischer-Tropsch derived base oil rather than the mineral base oil on which GF-A is based.

More surprising is the result of the four ball wear test. The performance of the grease formulation of the invention was outstanding, especially considering that it contained no recognised anti-wear additives. GF-1 gave a higher anti-wear effect than that provided by base greases containing lower thickener contents.

GF-1 also gave an excellent result in the Emcor rust test with distilled water. This too is surprising for an unadditivated grease.

Also outstanding, even up to 150° C., were the copper corrosion test results for GF-1.

The results of the oxidation test were also well within normal specifications for standard grease formulations, despite the absence of antioxidants.

Overall, the properties and performance of the grease formulation according to the invention are well within, and in many respects exceed, specifications for typical premium quality greases. Its stability, for example, is more in line with that of a lithium complex grease rather than a typical lithium hydroxide grease. Its performance in the four ball anti-wear test is comparable with that of high quality anti-wear additive-containing greases. This is despite the fact that GF-1 itself contains no additives.

Example 2

A second lithium grease formulation according to the invention, GF-2, was prepared using the base oil BO-2. The preparation method was as described in Example 1.

The finished formulation GF-2 was a light beige, almost white, grease containing 84.9 wt % of the base oil, 13.2 wt % of hydrogenated castor oil and 1.9 wt % of lithium hydroxide.

A number of relevant properties of the grease formulation GF-2 were measured using standard test methods. The same properties were also measured for a commercially available mineral oil-based grease formulation GF-B (ex-Shell). The results are shown in Table 3 below.

Neither GF-2 nor GF-B contained any performance enhancing additives.

TABLE 3

| Property | Test conditions | Test method | GF-1 | GF-B |
|---|---|---|---|---|
| Base fluid | | | BO-2 | SN150 mineral oil |
| Thickener content (wt %) | | — | 13.2 | 9.0 |
| Penetration | Undisturbed | ASTM D-217 | 308 | 311 |
| | 60 strokes | ASTM D-217 | 310 | 312 |
| | Difference | | 2 | 1 |
| 4-ball wear test (mm) | Wear, 40 kg, 1 hour | IP 239 | 0.60 | 0.88 |

The data in Table 3 confirm that the Fischer-Tropsch base oil BO-2 needs significantly more thickener (in this case 47% more) than does a conventional mineral oil, in order to make a grease with a specific consistency. This demonstrates that the effect is generally applicable to Fischer-Tropsch derived oils and not only to the specific high viscosity grade represented by BO-1.

Furthermore Table 3 confirms that the enhanced thickener content, brought about by the use of the Fischer-Tropsch derived base oil, leads to better anti-wear performance than the equivalent grease made in a conventional mineral base oil.

Thus the present invention can be seen to provide grease formulations with enhanced performance, and/or to make possible the preparation of greases with lower additive levels than might previously have been necessary in order to meet performance specifications. Lower additive levels can in turn reduce the cost and time required for manufacture, as well as the effort required in monitoring additive levels and qualities, for example to comply with legislative requirements, to meet consumer expectations and/or to safeguard users.

Example 3

A lithium complex grease formulation GF-3 was prepared according to the invention, and its properties tested and compared with those of a standard commercially available mineral oil-based grease GF-C.

The formulation GF-3 contained a major proportion of the Fischer-Tropsch derived base oil BO-1 described in Table 1 above. It was prepared using the following method, which was based on a standard Pretzsch kettle procedure.

Slurries of LiOH.H2O, boric acid, salicylic acid and water were added, in the proportions of 1 part solid to 5 parts water, to hydrogenated castor oil fatty acid in cold base oil. The mixture was heated in a sealed autoclave to 170° C. The steam was vented off and heating continued to 220° C. before the reaction mass was cooled and the product homogenised. The finished formulation GF-3 contained 76.2 wt % of the base oil and 12.6 wt % of hydrogenated castor oil; it did not contain any performance enhancing additives and was light beige in appearance.

A number of relevant properties of the grease formulation GF-3 were measured using standard test methods. The same properties were also measured for a commercially available mineral oil-based lithium complex EP (extreme pressure) grease formulation GF-C (ex-Shell). The results are shown in Table 4 below.

TABLE 4

| Property | Test conditions | Test method | GF-3 | GF-C |
|---|---|---|---|---|
| Base fluid | | | BO-1 | SN500 mineral oil |
| Thickener content (wt %) | | — | 12.6 | 9 |
| Penetration | Undisturbed | ASTM D-217 | 278 | 276 |
| Penetration | 60 strokes | ASTM D-217 | 285 | 279 |
| Dropping point (° C.) | Mettler automatic | IP 396 | >300 | 269 |
| Roll stability (Difference in penetration) | 18 hrs, 65 ° C. | ASTM D-1831 | 311 | 302 |
| | Difference | | 26 | 23 |
| Oil separation (% m/m) | 40° C., 7 days | IP 121 | 2.7 | 2.7 |
| 4-ball weld load (kg) | | ASTM D-2596 | 250 | 250 |
| Fafnir fretting test (mg) | | ASTM D-4170 | 7.2 | 10.1 |
| Oxidation stability (kPa) | 100 hrs | ASTM D-942 | 15.0 | 14.0 |
| | 400 hrs | ASTM D-942 | 30.0 | 59.0 |
| FAG FE-9 bearing life test (L50 hrs) | 150° C. | DIN 51821 | 120 | 131 |

Again the yield for GF-3 was significantly lower than for the conventional mineral oil grease, which confirmed predictions based on the lower polarity of the Fischer-Tropsch base oil.

The Table 4 data show that the stability and oil separation of GF-3 are in line with those of the conventional mineral-based grease formulation GF-C.

The dropping point of GF-3 is higher than that of GF-C, which is a consequence of the additive-free nature of GF-3. Many additives are known to reduce or depress the dropping point of a grease, and the absence of any additives removes the risk of this happening.

More surprising is the result of the four ball weld test. The performance of the additive-free grease formulation of the invention (GF-3) was identical to that of GF-C, which contains EP additives for the express purpose of improving the extreme pressure grease properties, including its performance in the four-ball weld test. The performance of GF-3 in the Fafnir fretting test, another indication of EP/wear properties, was also better than that of the additive-containing, mineral oil-based grease GF-C.

Equally surprisingly, the result of the oxidation test for GF-3 was in line with that of the mineral-oil benchmark GF-C after the standard test time of 100 hours, but was significantly better than GF-C after 400 hours. This indicates an inherent resistance to oxidation in GF-3, even with no oxidation inhibiting additives such as are included in GF-C.

The FAG FE-9 bearing life test at 150° C. provides further outstanding evidence of the efficacy of the high thickener content grease-forming properties of the Fischer-Tropsch base oils. The grease of the invention, GF-3, exceeded the 100 hour running time required of a fully-additivated, high performance lithium complex grease, despite its complete freedom from chemical additives of the type discussed above.

What is claimed is:

1. A grease formulation comprising:

a thickener that comprises a soap, wherein the soap is a metal salt of a $C_6$-$C_{20}$ fatty acid or a derivative thereof, wherein the metal is selected from the group consisting of lithium, sodium, magnesium, calcium, aluminum and a combination thereof, and the thickener is present in the grease formulation in an amount of from 5 to 20 wt %; and a base oil comprising a Fischer-Tropsch derived base oil, wherein the Fischer-Tropsch derived base oil has a kinematic viscosity at 100° C. of from 8 to 25 $mm^2/s$ and is present in the base oil in an amount of more than 90 wt %, and wherein the base oil is present in the grease formulation in an amount of from 60 to 95 wt %.

2. A grease formulation according to claim 1, wherein the Fischer-Tropsch derived base oil has a kinematic viscosity at 100° C. of from 10 to 25 $mm^2/s$.

3. A method, comprising: applying a grease formulation to the surfaces of two relatively moving components, wherein the grease formulation comprises:

a thickener that comprises a soap, wherein the soap is a metal salt of a $C_6$-$C_{20}$ fatty acid or a derivative thereof, wherein the metal is selected from the group consisting of lithium, sodium, magnesium, calcium, aluminum and a combination thereof, and the thickener is present in the grease formulation in an amount of from 5 to 20 wt %; and a base oil comprising a Fischer-Tropsch derived base oil, wherein the Fischer-Tropsch derived base oil has a kinematic viscosity at 100° C. of from 8 to 25 $mm^2/s$ and is present in the base oil in an amount of more than 90 wt %, and wherein the base oil is present in the grease formulation in an amount of from 60 to 95 wt %.

4. A method according to claim 3, wherein the Fischer-Tropsch derived base oil has a kinematic viscosity at 100° C. of from 8 to 20 $mm^2/s$.

5. A method according to claim 3, wherein the Fischer-Tropsch derived base oil has a kinematic viscosity at 100° C. of from 10 to 25 $mm^2/s$.

6. A method according to claim 3, wherein the Fischer-Tropsch derived base oil is present in the base oil in an amount of 100 wt %.

7. A grease formulation according to claim 1, wherein the Fischer-Tropsch derived base oil is present in the base oil in an amount of 100 wt %.

8. A grease formulation according to claim 1, wherein the Fischer-Tropsch derived base oil has a kinematic viscosity at 100° C. of from 10 to 25 $mm^2/s$.

9. A grease formulation according to claim 1, wherein the thickener is present in the grease formulation in an amount of from 10 to 20 wt %.

10. A grease formulation comprising:

a thickener that comprises a soap, wherein the soap is a metal salt of a $C_6$-$C_{20}$ fatty acid, wherein the metal is selected from the group consisting of lithium, sodium, calcium, aluminum and a combination thereof, and the thickener is present in the grease formulation in an amount of from 5 to 20 wt %; and a base oil comprising a Fischer-Tropsch derived base oil, wherein the Fischer-Tropsch derived base oil has a kinematic viscosity at 100° C. of from 8 to 25 $mm^2/s$ and is present in the base oil in an amount of more than 90 wt. %, and wherein the base oil is present in the grease formulation in an amount of from 60 to 95 wt %.

11. A grease formulation according to claim 10, wherein the Fischer-Tropsch derived base oil is present in the grease formulation in an amount of from 70 to 95 wt %.

12. A grease formulation according to claim 10, wherein the Fischer-Tropsch derived base oil is present in the grease formulation in an amount of from 80 to 95 wt %.

13. A grease formulation according to claim 10, wherein the Fischer-Tropsch derived base oil is present in the grease formulation in an amount of from 90 to 95 wt %.

14. A grease formulation comprising:

a thickener that comprises a soap, wherein the soap is a metal salt of a $C_6$-$C_{20}$ fatty acid or a derivative thereof, wherein the metal is selected from the group consisting of lithium, sodium, calcium, aluminum and a combination thereof, and the thickener is present in the grease formulation in an amount of from 5 to 20 wt %; and a base oil comprising a non-Fischer-Tropsch derived base oil and a Fischer-Tropsch derived base oil, wherein the Fischer-Tropsch derived base oil has a kinematic viscosity at 100° C. of from 8 to 25 $mm^2/s$, and wherein the non-Fischer-Tropsch derived base oil is present in the base oil in an amount less than 10 wt %, and wherein the base oil is present in the grease formulation in an amount of from 60 to 95 wt %.

15. A grease formulation according to claim 14, wherein the Fischer-Tropsch derived base oil has a kinematic viscosity at 100° C. of from 10 to 25 $mm^2/s$.

16. A grease formulation according to claim 14, wherein the thickener is present in the grease formulation in an amount of from 10 to 20 wt %.

17. A grease formulation according to claim 1, wherein the metal is selected from the group consisting of lithium, sodium and a combination thereof.

18. A method according to claim 3, wherein the metal is selected from the group consisting of lithium, sodium and a combination thereof.

* * * * *